US010112120B2

(12) United States Patent
Weidetz et al.

(10) Patent No.: US 10,112,120 B2
(45) Date of Patent: Oct. 30, 2018

(54) MODULAR TOY PLAY SETS

(71) Applicant: Mattel, Inc., El Segundo, CA (US)

(72) Inventors: Erich W Weidetz, Los Angeles, CA (US); Jebraeil Samo, Rowland Heights, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 15/297,038

(22) Filed: Oct. 18, 2016

(65) Prior Publication Data

US 2018/0104612 A1 Apr. 19, 2018

(51) Int. Cl.
*A63H 33/04* (2006.01)
*A63H 33/10* (2006.01)
*A63H 33/08* (2006.01)

(52) U.S. Cl.
CPC ..... *A63H 33/08* (2013.01); *A63H 33/042* (2013.01); *A63H 33/086* (2013.01)

(58) Field of Classification Search
CPC ..... A63H 33/04; A63H 33/08; A63H 33/086; A63H 33/088; A63F 3/00214; A63F 3/00574
USPC ..... 446/85, 108, 111, 118, 124, 125; 273/282.1
See application file for complete search history.

(56) References Cited

U.S. PATENT DOCUMENTS 2,120,610 A 6/1938 Howard
3,242,610 A * 3/1966 Christiansen ..... A63H 33/086 446/128
3,422,564 A 1/1969 Izumi
3,454,156 A 7/1969 Chatten
3,577,671 A * 5/1971 Woollett ..... A63H 33/086 220/23.2
3,594,940 A * 7/1971 Yonezawa ..... A63H 33/04 446/108
3,636,230 A * 1/1972 Tacey ..... A63H 33/088 434/211
3,718,218 A 2/1973 Shields
3,804,234 A 4/1974 Gordon
(Continued)

FOREIGN PATENT DOCUMENTS

CH 385698 A 12/1964
DE 2521195 12/1976
(Continued)

OTHER PUBLICATIONS

German Patent and Trademark Office, "Office Action" in connection with related German Patent Application No. 10 2017 218 538.4, dated May 22, 2018, 12 pages.

*Primary Examiner* — Alexander Niconovich
(74) *Attorney, Agent, or Firm* — Edell, Shapiro & Finnan, LLC

(57) ABSTRACT

Toy play systems are disclosed. A toy play system may include a first toy play set having a first base. The first base may include opposed upper and lower sides, the upper side may include at least one play feature and the lower side may include a plurality of protrusions. The toy play system may further include a base connector which may have at least two coupling structures. At least a first coupling structure of the at least two coupling structures may frictionally engage a protrusion of the plurality of protrusions. At least a second coupling structure of the at least two coupling structures may frictionally engage a second toy play set.

20 Claims, 21 Drawing Sheets

(56) References Cited

U.S. PATENT DOCUMENTS 3,877,170 A * 4/1975 Bakker ..... A63H 33/088 446/124
4,120,396 A 10/1978 Mascia et al.
4,195,732 A 4/1980 Bell
4,728,310 A * 3/1988 Valtolina ..... A63H 33/107 446/111
4,739,884 A 4/1988 Duplessy
4,813,904 A * 3/1989 Larws ..... A63H 33/088 446/118
4,896,774 A 1/1990 Hammett et al.
4,903,969 A * 2/1990 Williams, Jr. ..... A63F 3/00097 273/248
4,919,260 A 4/1990 Cunningham
5,048,840 A * 9/1991 Johnson, Jr. ..... A63F 3/00214 273/241
5,213,211 A 5/1993 Umiker
5,421,270 A * 6/1995 Kelly ..... A47B 13/16 108/159
5,636,753 A 6/1997 Wilkinson et al.
5,799,943 A * 9/1998 Morgan ..... A63F 3/0423 273/160
5,876,262 A * 3/1999 Kelly ..... A63H 33/22 108/23
6,119,861 A 9/2000 Schneider
6,129,605 A * 10/2000 Cyrus ..... A63H 33/04 446/108
6,997,331 B2 * 2/2006 Lobe ..... B65D 19/44 211/59.4
7,169,361 B2 1/2007 Arnold, Jr. et al.
7,467,714 B2 12/2008 Slat et al.
7,661,527 B2 2/2010 Cerf
8,109,803 B2 * 2/2012 Kichijo ..... A63H 33/108 428/33
8,851,287 B2 10/2014 Becklin
8,961,259 B2 * 2/2015 Maggiore ..... A63H 33/062 446/120
9,010,759 B2 4/2015 McDonnell
9,101,212 B2 8/2015 De Roeck
9,517,423 B1 * 12/2016 Kanbar ..... A63H 33/042
9,937,433 B2 * 4/2018 Stolten ..... A63H 33/10
2006/0163811 A1 7/2006 Chuang
2008/0099362 A1 5/2008 Cerf
2009/0288976 A1 11/2009 Shiraki et al.
2013/0146498 A1 6/2013 Chen
2013/0217296 A1 * 8/2013 Widjaja ..... A63H 33/101 446/124
2014/0138909 A1 5/2014 Makowka et al.
2014/0315466 A1 10/2014 Murtagh

FOREIGN PATENT DOCUMENTS

DE 3003314 A1 8/1981
DE 102010012518 A1 9/2011

* cited by examiner

MODULAR TOY PLAY SETS

BACKGROUND

Sandbox video games, which give a user the freedom to explore and create in a digital realm, are popular with people of all ages. Some examples of such video games allow users to navigate and create in a three-dimensional virtual world made of textured cubes. In some instances, a user, or the parent of a user, may wish to have a physical toy that mimics the look and gameplay of a digital video game. Such a physical toy could be used in conjunction with the digital video game or in place of the video game in order to spend less time looking at a screen.

SUMMARY

In some embodiments, a toy play system may include a first toy play set having a first base. The first base may include opposed upper and lower sides, the upper side may include at least one play feature and the lower side may include a plurality of protrusions. The toy play system may further include a base connector which may have at least two coupling structures. At least a first coupling structure of the at least two coupling structures may frictionally engage a protrusion of the plurality of protrusions. At least a second coupling structure of the at least two coupling structures may frictionally engage a second toy play set.

In some embodiments, a toy play system may include a first toy play set having a first base. The first base may include opposed first upper and lower portions. The first upper portion may include at least one first play feature and the first lower portion may include a plurality of first protrusions. The toy play system may include a second toy play set having a second base. The second base may include opposed second upper and lower portions. The second upper portion may include at least one second play feature and the second lower portion may include a plurality of second protrusions. The toy play system may further include a base connector having a plurality of coupling structures. One coupling structure of the plurality of coupling structures may be configured to be coupled with a first protrusion of the plurality of first protrusions. Another coupling structure of the plurality of coupling structures may be configured to be coupled with a second protrusion of the plurality of second protrusions.

Features, functions, and advantages may be achieved independently in various embodiments of the present disclosure, or may be combined in yet other embodiments, further details of which can be seen with reference to the following description and drawings.

DESCRIPTION

Overview

Various embodiments of a toy play system having modular bases and base connectors are described below and illustrated in the associated drawings. Unless otherwise specified, the toy play system and/or its various components may contain at least one of the structure, components, functionality, and/or variations described, illustrated, and/or incorporated herein. Furthermore, the structures, components, functionalities, and/or variations described, illustrated, and/or incorporated herein in connection with the present teachings may be included in other similar modular structures. The description of various embodiments below is merely illustrative in nature and is in no way intended to limit the disclosure, its application, or uses. Additionally, the advantages provided by the embodiments, as described below, are illustrative in nature and not all embodiments provide the same advantages or the same degree of advantages.

EXAMPLES, COMPONENTS, AND ALTERNATIVES

The following sections describe selected aspects of illustrative toy play systems as well as related apparatuses and/or methods. The examples in these sections are intended for illustration and should not be interpreted as limiting the entire scope of the present disclosure. Each section may include one or more distinct inventions, and/or contextual or related information, function, and/or structure.

Example 1

Figure 1:
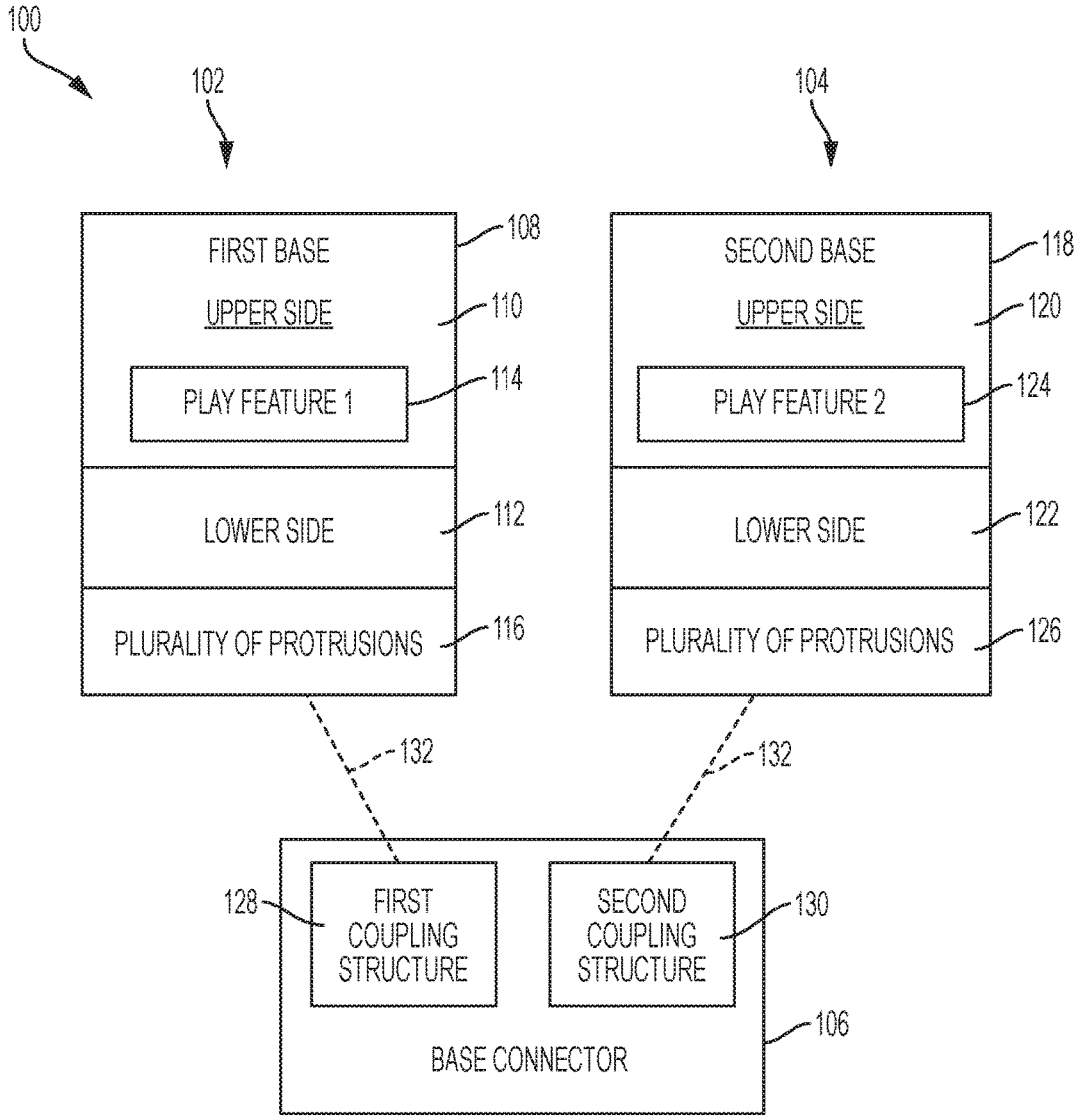
FIG. 1 is a block diagram of an illustrative toy play system.

This example describes an illustrative toy play system having a first toy play set, a second toy play set, and a base connector; see FIG. 1.

FIG. 1 is a block diagram of an illustrative toy play system, generally indicated at 100. Toy play system 100 may include a first toy play set 102, a second toy play set 104, and a base connector 106.

First toy play set 102 may have a first base 108. The first base may include a first upper portion or a first upper side 110, which also may be referred to as a first upper play side. The first upper side may be opposed to a first lower portion or a first lower side 112, which also may be referred to as a first bottom connector side. The upper side may include at least one play feature 114 and the lower side may include a plurality of first protrusions or projections 116. The first base may be a three-dimensional object and may, for example, be formed of molded plastic and/or other appropriate material(s). The upper side 110 may have a shape or topology configured or designed to mimic the appearance of, for example, a landscape, cityscape, or video game setting. The upper side 110 may be colored or textured in order to mimic the appearance of a real or imagined space or surface.

Play feature 114 may be a first play feature. First base 108 may include more than one play feature. Play feature 114 may be any feature configured to be interacted with by a user during play. In some examples, play feature 114 may include one or more components that are movably mounted to the first base, for example, on the upper side. A few non-limiting examples of play features include a button, a spring-loaded movable piece, a movable surface or panel, a movable three-dimensional structure, an extendable bridge, a movable wall, and a launch pad, among others. Play feature 114 may include a combination of such elements or a single such element. Play feature 114 may be designed or configured to mimic the gameplay of an element of a digital video game.

First lower side or portion 112 may be configured to support first toy play set 102 on a support surface, for example on a table. The lower side of first base 102 may also be configured to facilitate coupling of first base 108 of the first toy play set to second toy play set 104. In some examples, the lower side of the first base may be configured to facilitate coupling of the first base to the second toy play set, a third toy play set, a fourth toy play set, and/or additional toy play set(s).

The plurality of protrusions 116 may extend from lower side 112 in a direction away from upper side 110. The plurality of protrusions may facilitate securing or coupling first toy play set 102 to second toy play set 104. The plurality of protrusions may contact the support surface when the first toy play set is supported by the lower side of the first toy play set.

Second toy play set 104 may be substantially similar to first toy play set 102. In particular, the second toy play set may have a second base 118 which may include a second upper side or portion 120 and a second lower side or portion 122. The second upper portion may include at least one second play feature 124 and the second lower side or portion may include a plurality of second protrusions or projections 126. The lower side 122 of the second toy play set, including plurality of protrusions 126, may be substantially similar to the lower side 112 of the first toy play set, including plurality of first protrusions 116.

Upper side 120 of second base 118 may be similar to upper side 110 of first base 108. That is, the upper side of second toy play set 104 may be designed, configured, colored, and/or textured in order to mimic the appearance of the same landscape, cityscape, or video game setting in the upper side of the first toy play set 102. In other words, the first and second toy play sets may mimic different aspects or settings of the same video game. Additionally, second play feature 124 may be similar to, but different from, first play feature 114. Combining the first and second toy play sets together may then create a larger physical representation of the virtual game than either of the individual first and second toy play sets separately.

Base connector 106 may be configured to secure first toy play set 102 to second toy play set 104. Base connector 106 may have at least two coupling structures, such as a first coupling structure 128 and a second coupling structure 130. One of the at least two coupling structures, say first coupling structure 128, may frictionally engage a first protrusion of the plurality of first protrusions 116 in order to secure base connector 106 to first toy play set 102. The other of the at least two coupling structures, say second coupling structure 130, may frictionally engage a second protrusion of the plurality of second protrusions 126 in order to secure the base connector to second toy play set 104. The frictional engagement is indicated schematically in FIG. 1 at dashed lines 132. Examples of first and second coupling structures 128, 130 include apertures, recesses, depressions, and/or other structure(s) configured to frictionally engage the protrusions or projections of the lower side of one or more of the above toy play sets.

Base connector 106 may be secured to one or both of first toy play set 102 and second toy play set 104 by frictional engagement 132 between the coupling structures of the base connector and the pluralities of protrusions on the lower sides of the toy play sets. The frictional engagement may include static friction forces between the coupling structures and the pluralities of protrusions. The base connector may be secured to one or more of the toy play sets without the benefit of normal forces as would occur if the coupling between the base connector and the plurality of protrusions included any overhanging latches. That is, frictional forces may be substantially the only forces holding the base connector in a secured position relative to one or more of the toy play sets.

The plurality of first protrusions 116 and the plurality of second protrusions may contact the support surface when the respective first and second toy play sets 102 and 104 are supported by their respective lower sides 112 and 122. The plurality of first and/or second protrusions may be sized or dimensioned to contact the support surface even when the first toy play set is coupled to the second toy play set via base connector 106.

Although the lower side of the above toy play sets are shown to include protrusions, one or more of the lower sides may alternatively, or additionally, include one or more other coupling structures that are configured to frictionally engage and/or couple with one or more of the coupling structures of the base connector. In some embodiments, the lower side of the above toy play sets may alternatively, or additionally, include one or more recesses, while the base connector may alternatively, or additionally, include one or more corresponding protrusions or projections that are configured to frictionally engage and/or couple with the recesses.

Toy play system 100 may be modular in the sense that each of the toy play sets included in the system may have a common connection configuration on the lower sides of the toy play sets. Toy play system 100 may include any number of toy play sets including any number of different or similar play features on the respective upper sides. Toy play system 100 may include a plurality of base connectors substantially identical to base connector 106. Any base connector of the plurality of base connectors may be configured to secure any two of the toy play sets to one another. In some examples, any base connector of the plurality of base connectors may be configured to secure more than two of the toy play sets to one another, such as three, four, or more toy play sets. Further, any two play sets of system 100 may be secured to one another via a base connector in a variety of relative orientations. In some examples, toy play system 100 may include only first toy play set 102 and base connector 106 without a second toy play set.

Example 2

Figure 2:
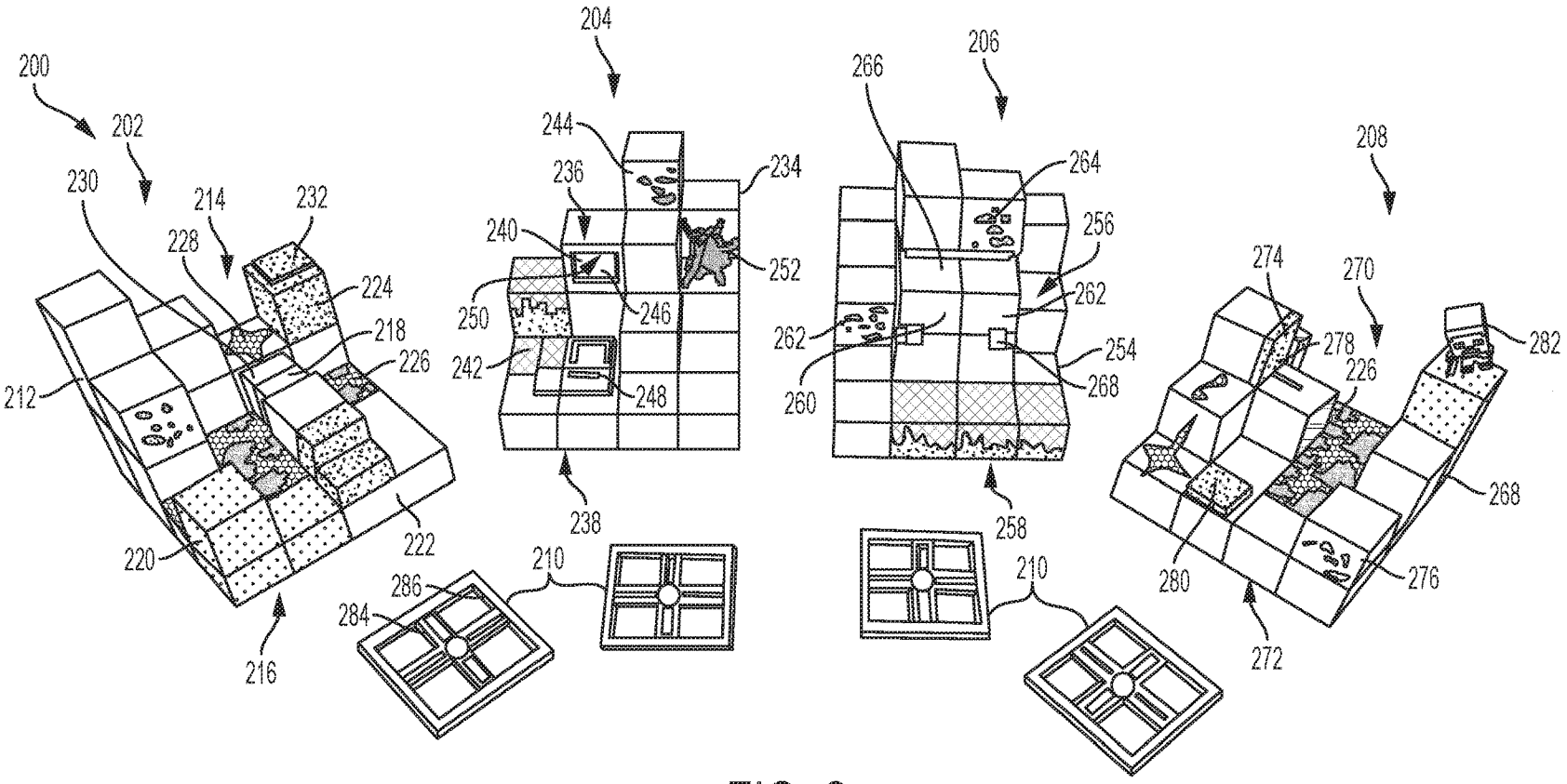
FIG. 2 is a perspective view of an embodiment of the toy play system of FIG. 1, including a plurality of toy play sets and base connectors.

This example describes an illustrative toy play system having a first toy play set, a second toy play set, a third toy play set, a fourth toy play set, and four base connectors; see FIG. 2.

FIG. 2 is a perspective view of an embodiment of a toy play system, generally indicated at 200. Toy play system 200 is an embodiment of toy play system 100, and the various features and benefits of toy play system 100 will not be repeated in their entirety. Toy play system 200 includes a first toy play set 202, a second toy play set 204, a third toy play set 206, a fourth toy play set 208, and four base connectors 210. Any of the toy play sets of system 200 may be similar to any of the toy play sets of system 100.

Toy play system 200 may be designed and/or configured to mimic, for example, the appearance and/or gameplay of a video game. Portions of system 200 may be colored and/or textured so as to evoke the appearance of the digitally created worlds of that game. System 200 may also include play features similar to those found in the virtual game. For example, the virtual worlds in the video game are highly reconfigurable. The play features of system 200 may allow a user to reconfigure system 200. Further, the modular nature of the toy play sets within system 200 may allow for a large variety of physical environments to be created by coupling the toy play sets together with base connectors in different ways.

First toy play set 202 may have a first base 212. First base 212 may include a first upper side or portion 214 and a first lower side or portion 216 opposed to the first upper portion. The first upper portion may include at least one first play feature 218. First upper portion 214 may have the appearance of being constructed largely of blocks or cubes. In the embodiment shown in FIG. 2, first base 212 appears to have a length of four blocks, a width of four blocks, and a varying height of between one and four blocks. The blocks may be colored or textured to indicate different environments, such as one or more sand blocks 220, stone blocks 222, dirt blocks 224, lava blocks 226, and redstone circuit blocks 228, among others.

First play feature 218 may include at least one component that is movably connected to the first upper side 214. The at least one component may include a bridge 230 movably connected to the first upper side. Play feature 218 may further include a mechanism 232 configured to move the bridge between an extended position (shown in FIG. 2) and a retracted position. The mechanism 232 may be configured to move the bridge between the retracted position and the extended position. Mechanism 232 may, for example, include a triggering button. Bridge 230 may include two bridge portions that extend from respective blocks of the first upper side and meet in order to span a gap between the respective blocks. Additional features and internal components of first play feature 218 are described in reference to FIGS. 16 and 17 below.

Second toy play set 204 may have a second base 234. Second base 234 may include a second upper side or portion 236 and a second lower side or portion 238 opposed to the second upper portion. The second upper portion may include at least one second play feature 240. Second upper portion 236 may appear to be constructed of blocks as with first upper portion 214. Second upper portion 236 may appear to be stacks of blocks of varying height disposed over a four block by four block grid. The blocks may be colored or textured to indicate, for example, grass blocks 242 and emerald ore blocks 244, among others.

Second play feature 240 may include at least one component that is movably connected to the second upper side 236. The at least one component may include a panel 246 movably connected to the upper side. The at least one second play feature 240 may further include a mechanism 248 configured to move panel 246 among a plurality of positions. Mechanism 248 may be configured to display one or more images at panel 246. In some examples, mechanism 248 may include a triggering button. Panel 246 may be visible to a user though an aperture 250 in second upper portion 236. Additional features and internal components of second play feature 240 are described in reference to FIGS. 18 and 19 below.

Second toy play set 204 may include an item 252 which may be an accessory that is unattached to second base 234. Item 252 may then be placed by a user at any location on second base 234 or any of the other bases in toy play system 200. In the embodiment shown in FIG. 2, item 252 is designed to indicate a cobweb, though many other possibilities exist. In some examples, item 252 may be removably attached to second toy play set 204, perhaps via a post on the bottom of item 252 configured to be received by an aperture in the upper portion 236 of the second toy play set.

Third toy play set 206 may have a third base 254. Third base 254 may include a third upper side or portion 256 and a third lower side or portion 258 opposed to the third upper portion. The third upper portion may include at least one third play feature 260. Third upper portion 256 may appear to be constructed of blocks as with first upper portion 214 and second upper portion 236. The blocks may be colored or textured to indicate, for example, coal ore blocks 262 and gold ore blocks 264, among others.

Third play feature 260 may include at least one component that is movably connected to the third upper side 256. The at least one component may include a manual flip down section 266 of one or more blocks. Flip down section 266 is coupled to the rest of third upper portion 256 via a hinge 268. Flip down section 266 may include one or more whole blocks and rotating the flip down section relative to the remainder of the third upper portion may reconfigure the third upper portion to a different topography. Flip down section 266 may include one or more portions of blocks, for example half blocks cut along a diagonal line, so that rotating the flip down section relative to the third upper portion exposes an angled surface. The angled surface may be colored or textured, for example, to indicate water or a waterfall. Additional features and components of third play feature 260 are described in reference to FIG. 20 below.

Fourth toy play set 208 may have a fourth base 268. Fourth base 268 may include a fourth upper side or portion 270 and a fourth lower side or portion 272 opposed to the fourth upper portion. The fourth upper portion may include at least one fourth play feature 274. Fourth upper portion 270 may appear to be constructed of blocks as with first upper portion 214, second upper portion 236, and third upper portion 256. The blocks may be colored or textured to indicate, for example, lapis lazuli ore blocks 276 and lava blocks 226 as in first toy play set 202, among others.

Fourth play feature 274 may include at least one component that is movably connected to fourth upper side 270. The at least one component may include a wall 278 movably connected to fourth upper side 270. The fourth play feature may further include a mechanism 280, which may include a triggering button, configured to move the wall from a retracted position (shown in FIG. 2) toward an extended position. The extended position of the wall may be horizontally displaced from the retracted position. Additional features and internal components of fourth play feature 274 are described in reference to FIG. 21 below.

Fourth toy play set 208 may include a figurine 282 which may be unattached to fourth base 268. Figurine 282 may represent an avatar or a player from a video game. Figurine 282 may be placed by a user at any location on fourth base 268 or any of the other bases in toy play system 200. In the case where figurine 282 is placed proximate wall 278 when wall 278 is in the retracted position, and mechanism 280 is subsequently activated, wall 278 may cause figurine 282 to be launched sideways as wall 278 extends to the extended position.

Any of base connectors 210 may be similar to base connector 106 described above. Each of the base connectors may be substantially identical to each of the remaining base connectors. Any of the base connectors 210 may have at least two coupling structures. One coupling structure 284 may be configured to secure the base connector to any one of the toy play sets of toy play system 200, and another coupling structure 286 configured to secure the base connector to any of one of the remaining toy play sets of toy play system 200.

Example 3

This example describes an illustrative toy play system having a first toy play set and a base connector; see FIGS. 3-9.

Figure 3:
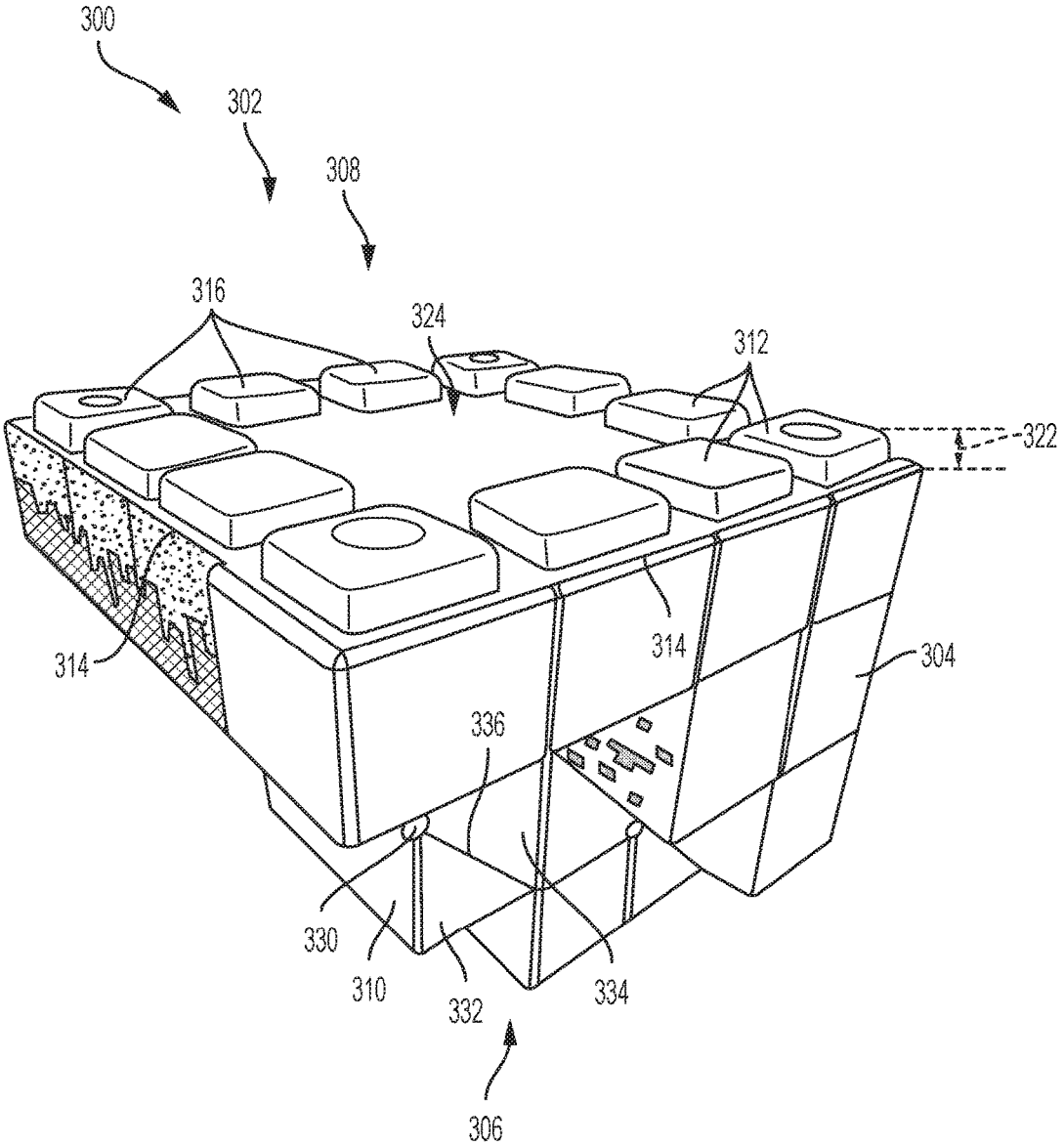
FIG. 3 is a perspective view of a lower side of an embodiment of a base of a toy play set of FIG. 2, showing a plurality of protrusions.
Figure 4:
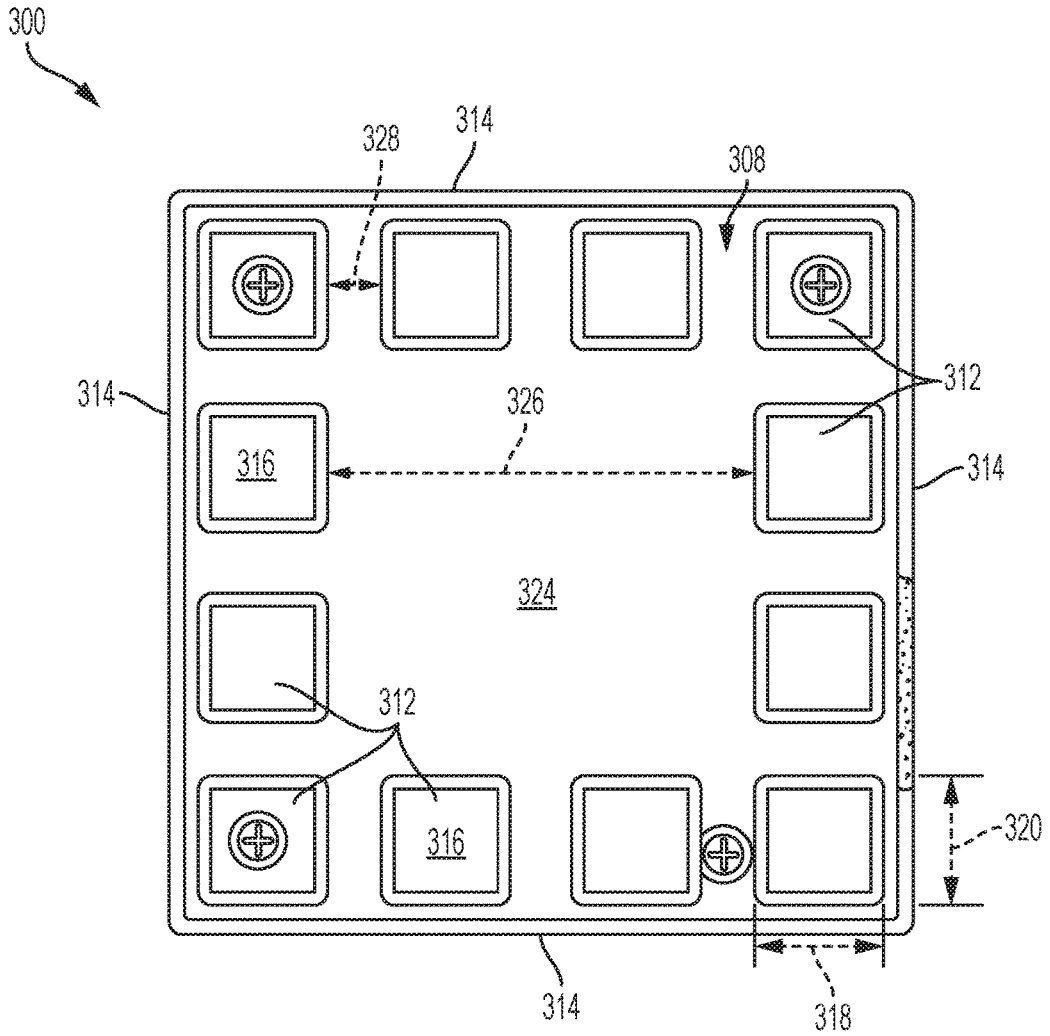
FIG. 4 is a bottom plan view of the base of the toy play set of FIG. 3.

FIG. 3 is a perspective view of an embodiment of a toy play system, generally indicated at 300. FIG. 4 is a bottom plan view of a base of the toy play system 300. FIGS. 3 and 4 are herein described together. Toy play system 300 is an embodiment of toy play system 100, with the exception of including only a first toy play set, and the various features and benefits of toy play system 100 will not be repeated in their entirety.

Toy play system 300 may include a first toy play set 302 having a first base 304. First base may include an upper side or portion 306 and a lower side or portion 308. The upper and lower sides may be opposed to one another. The upper side may include at least one play feature 310 and the lower side may include a plurality of protrusions or projections 312. First toy play set 302 may be similar to third toy play set 206 described above.

Lower side 308 may be defined by a plurality of edges 314. In the embodiment shown in FIGS. 3 and 4, the plurality of edges includes four edges and each of the plurality of edges has a common length so that the lower side has a square shape. Other number of edges are also possible, as are edges having different lengths.

The plurality of protrusions 312 may be arranged along one or more of the plurality of edges 314, for example along each of the plurality of edges. Each protrusion of the plurality of protrusions may include an end surface 316 that is configured to engage a support surface when first toy play set 302 is placed on the support surface.

Each of the plurality of protrusions 312 may have the same dimensions or about the same dimensions as the other protrusions of the plurality of protrusions. In some examples, the end surfaces 316 of the plurality of protrusions may be square-shaped. That is, each protrusion may have a common protrusion width 318, a common protrusion length 320, and a common protrusion height 322 away from the rest of lower side 308.

Lower side 308 of first base 304 may include a central portion or area 324 that is free from protrusions 312 such that a gap 326 is defined between protrusions 312, such as between protrusions 312 along two opposing edges 314. The gap 326 between protrusions along two opposing edges may be substantially larger than a gap 328 between any two adjacent protrusions along a common edge 314. The gap 328 between adjacent protrusions 312 may be common to any pair of adjacent protrusions along a common edge 314.

Lower side 308 may be modular in the sense that the gap 328 or spacing between any two adjacent protrusions is common around the plurality of edges of the lower side and the plurality of protrusions 312 themselves may all have the same dimensions. Lower side 308 may also have a degree of symmetry. In the embodiment shown in FIGS. 3 and 4, rotating first base 304 by ninety degrees about an axis perpendicular to the lower side and through the center of the lower side may return the lower side to substantially the same configuration. Note that the upper side 306 of first base 304 may not return to the same configuration during such a rotation.

Play feature 310 of upper side 306 may include a hinge 330 and one or more half-blocks 332 rotatably connected to one or more half-blocks 334 at hinge 330. The half-blocks 332 may have a first position (shown in FIG. 3) where adjacent faces of the half-blocks 332 and 334 meet along a diagonal 336 and a second position where the formerly adjacent faces of the half-blocks 332 and 334 together form a surface which is angled relative to the remainder of upper portion 306.

Figure 5:
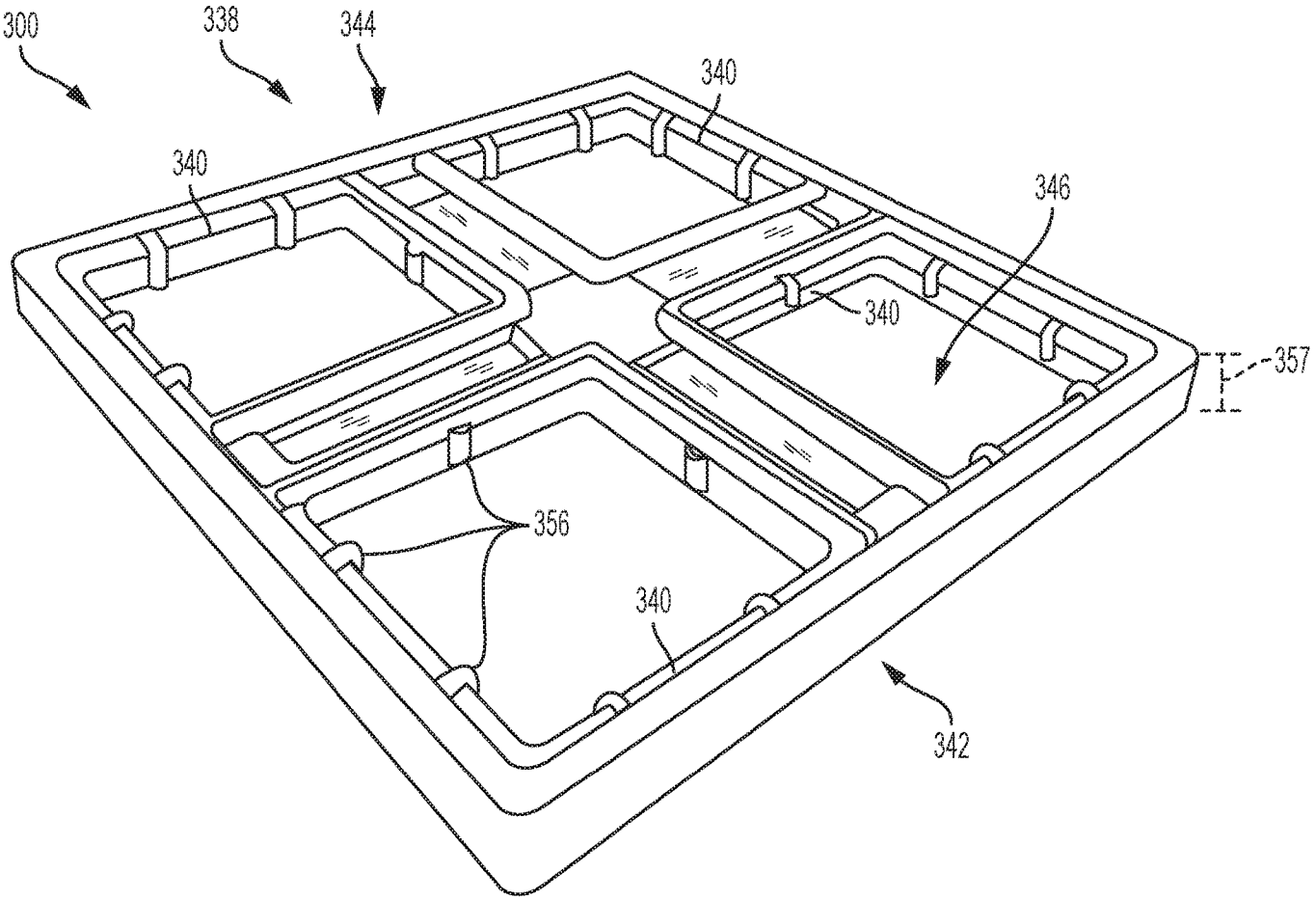
FIG. 5 is an upper perspective view of an embodiment of a base connector of the toy play system of FIG. 2.
Figure 6:
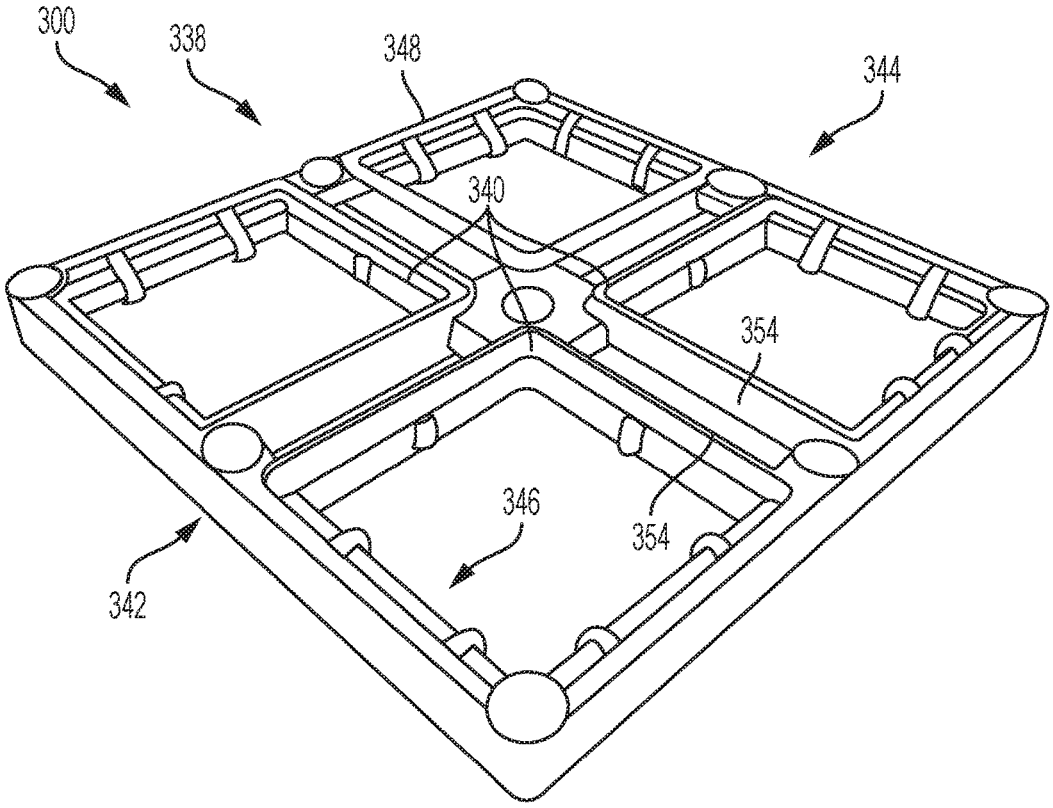
FIG. 6 is a lower perspective view of the base connector of FIG. 5.
Figure 7:
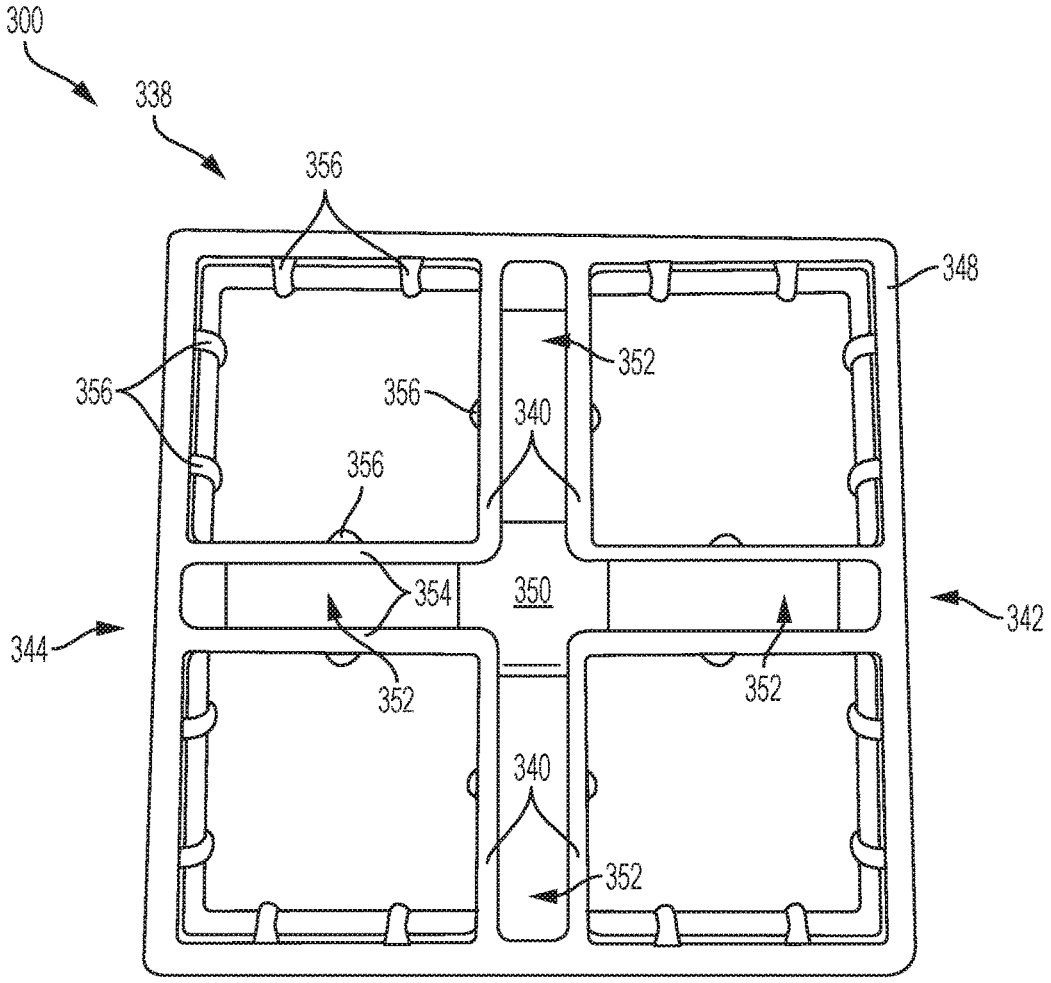
FIG. 7 is a top plan view of the base connector of FIG. 5.

FIG. 5 is an upper perspective view of an embodiment of a base connector 338 of toy play system 300. FIG. 6 is a lower perspective view of base connector 338. FIG. 7 is a top plan view of base connector 338. FIGS. 5-7 are herein described together.

Base connector 338 may include coupling structures 340. One or more of the coupling structures 340 may be configured to frictionally engage one or more protrusions of the plurality of protrusions shown in FIGS. 3-4 in order to secure base connector 338 to the first toy play set. One or more other coupling structures may be configured to frictionally engage a second toy play set in order to secure the base connector to the second toy play set. Each of the coupling structures 340 may be substantially identical to another of the coupling structures.

Base connector 338 may include a first end portion 342 and a second end portion 344 opposed to first end portion 342. The first end portion may include at least two coupling structures 340. The second end portion may include at least two coupling structures 340. In the embodiment shown in FIGS. 5-7, base connector 338 has four coupling structures and has a generally square shape.

Note that each of the coupling structures 340 of the at least two coupling structures may have the same or about the same dimensions as other coupling structures 340 of the at least two coupling structures. Each of the at least two coupling structures may include a hole or an aperture 346 sized to receive a protrusion of the plurality of protrusions 312 shown in FIGS. 3 and 4.

Base connector 338 may include a frame 348 having the at least two connecting structures 340. Frame 348 may be formed integrally with the coupling structures 340 and may maintain a constant disposition of the coupling structures relative to one another. In the embodiment shown in FIGS. 5-7, base connector 338 includes a connection member 350 coupled to the four coupling structures 340 and a plurality of apertures 352 exist between each adjacent pair of coupling structures 340. Apertures 352 may allow internal side walls 354 of the coupling structures 340 to flex toward one another within apertures 352 when one or more of the coupling structures are engaged with a protrusion of the plurality of protrusions. In another embodiment, connection member 350 may completely fill the space between adjacent coupling structures 340, i.e., fill the space currently designated as apertures 352.

Frame 340 may include a plurality of spaced apart ribs 356 around each aperture. Ribs 356 may facilitate frictional engagement between coupling structures 340 and protrusions. Ribs 356 may or may not be evenly spaced along a periphery of apertures 346.

Base connector 338 may have a thickness 357 which may be comparable to protrusion height 322 shown in FIG. 3. In some embodiments, thickness 357 may be the substantially the same as protrusion height 322. In some embodiments, thickness 357 may be slightly smaller than protrusion height 322 so that when base connector 338 is engaged with the lower portion 308 of first base 304, as described below in reference to FIG. 8, the end surfaces 316 of the plurality of protrusions 312 may make contact with a support surface when the toy play set is supported on a support surface by the lower portion.

Figure 8:
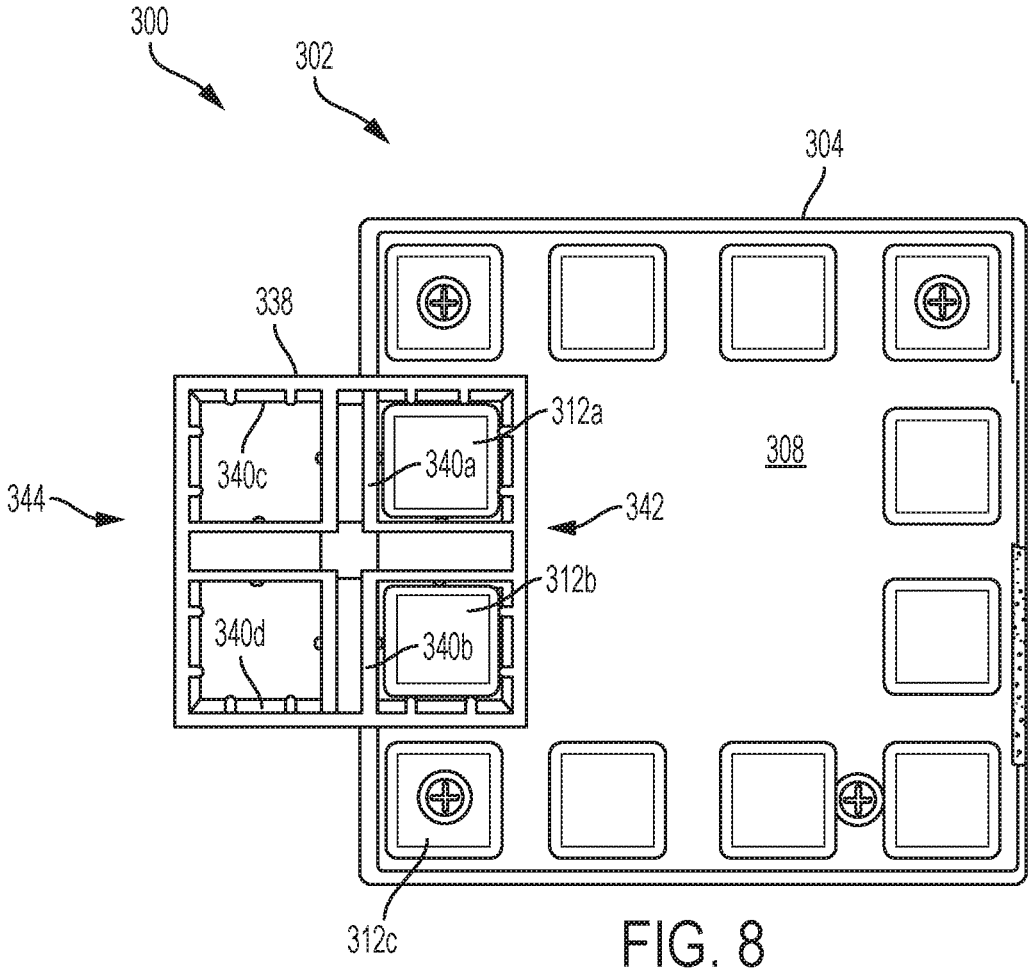
FIG. 8 is a bottom plan view of a base connector coupled to a base of a toy play set of the toy play system of FIG. 2.

FIG. 8 is a bottom plan view of first base 304 secured to base connector 338 of toy play system 300. FIG. 8 may represent a connecting configuration of toy play system 300 where base connector 338 is in a position to further be secured to a second base of a second toy play set. The connecting configuration shown in FIG. 8 may be one of many possible connecting configurations.

FIG. 8 shows system 300 with at least two coupling structures, denoted as 340*a* and 340*b*, of first end portion 342 that frictionally engage two of the plurality of protrusions, denoted as 312*a* and 312*b*, of the lower side of the first toy play set 302 to secure base connector 338 to the first toy play set. Coupling structure 340*a* is engaged with protrusion 312*a* and coupling structure 340*b* is engaged with protrusion 312*b*. Note that the at least two coupling structures 340*a* and 340*b* of the first end portion may frictionally engage two adjacent protrusions 312*a* and 312*b* of the plurality of protrusions along the same edge of lower side 308 of first toy play set 302.

Further, at least two coupling structures, denoted as 340*c* and 340*d*, of second end portion 344 are configured to frictionally engage a second toy play set to secure base connector 338 to the second toy play set. Such a second toy play set may have a lower side or portion similar to the lower side or portion 308 of first toy play set 302.

Another connecting configuration of toy play system 300 may include base connector 338 rotated clockwise by ninety degrees so that coupling structure 340*c* frictionally engages protrusion 312*a* and coupling structure 304*a* frictionally engages protrusion 312*b*. Other similar rotations are also possible to achieve a connecting configuration.

Still another connecting configuration of toy play system 300 may include base connector 338 disposed so that coupling structure 340*a* frictionally engages protrusion 312*b* and coupling structure 340*b* frictionally engages protrusion 312*c*. Still another connecting configuration of toy play system 300 may include base connector 338 disposed so that coupling structure 340*a* frictionally engages protrusion 312*c* and none of coupling structures 340*b*, 340*c*, and 340*d* engage a protrusion. Many other connecting configurations also exist.

Figure 9:
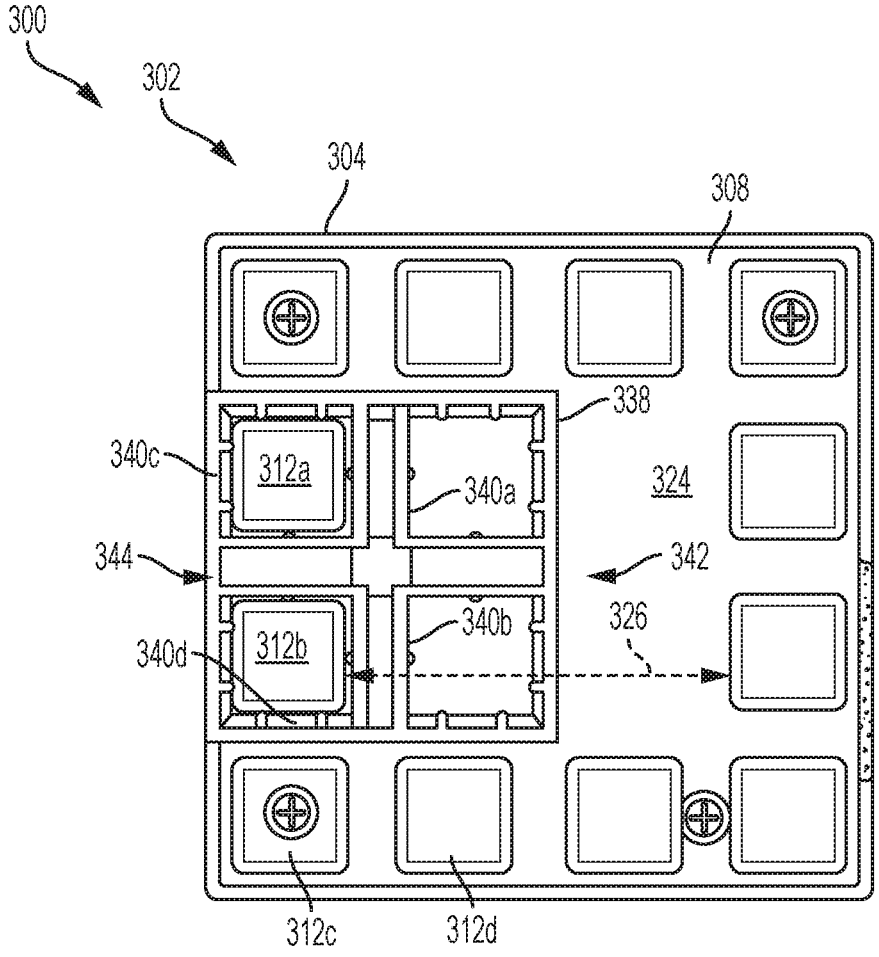
FIG. 9 is a bottom plan view of a base connector coupled to a base of a toy play set of the toy play system of FIG. 2, showing the base connector in a stored configuration.

FIG. 9 is a bottom plan view of first base 304 secured to base connector 338 of toy play system 300. FIG. 9 may represent a storage configuration of toy play system 300 where base connector 338 may not be in a position to be secured to a second base of a second toy play set. The storage configuration of toy play system shown in FIG. 9 may be one or many possible storage configurations. In a storage configuration, base connector 338 may not frictionally engage a second toy play set.

In the storage configuration shown in FIG. 9, gap 326 may be sized to receive one of the first and second end portions 342 and 344 of base connector 338 when the at least two coupling structures 340 of the other of the first and second end portions frictionally engages two of the plurality of protrusions of the lower side 308 of first toy play set 302. For example, gap 326 and/or central area 324 may be sized to receive the first end portion 342 when coupling structures 340*c* and 340*d* of second end portion 344 are frictionally engaged with protrusions 312*a* and 312*b*. In the storage configuration, coupling structures 340*a* and 340*b* are not in a position to frictionally engage a second toy play set and may be largely hidden from view underneath the toy play set when the lower side is resting on a support surface. Alternatively, gap 326 and/or central area 324 may be sized to receive the second end portion when the coupling structures of the first end portion are frictionally engaged with the protrusions.

Many other storage configurations are also possible, for example, by rotating base connector 338 relative to first base 304 by ninety degrees. Another storage configuration may include coupling structure 340*c* engaged with protrusion 312*b*, coupling structure 340*d* engaged with protrusion 312*c*, coupling structure 340*b* engaged with protrusion 312*d*, and coupling structure 340*a* received within central area 324.

Example 4

This example describes an illustrative toy play system having a first toy play set, a second toy play set, and a base connector; see FIGS. 10-13.

Figure 10:
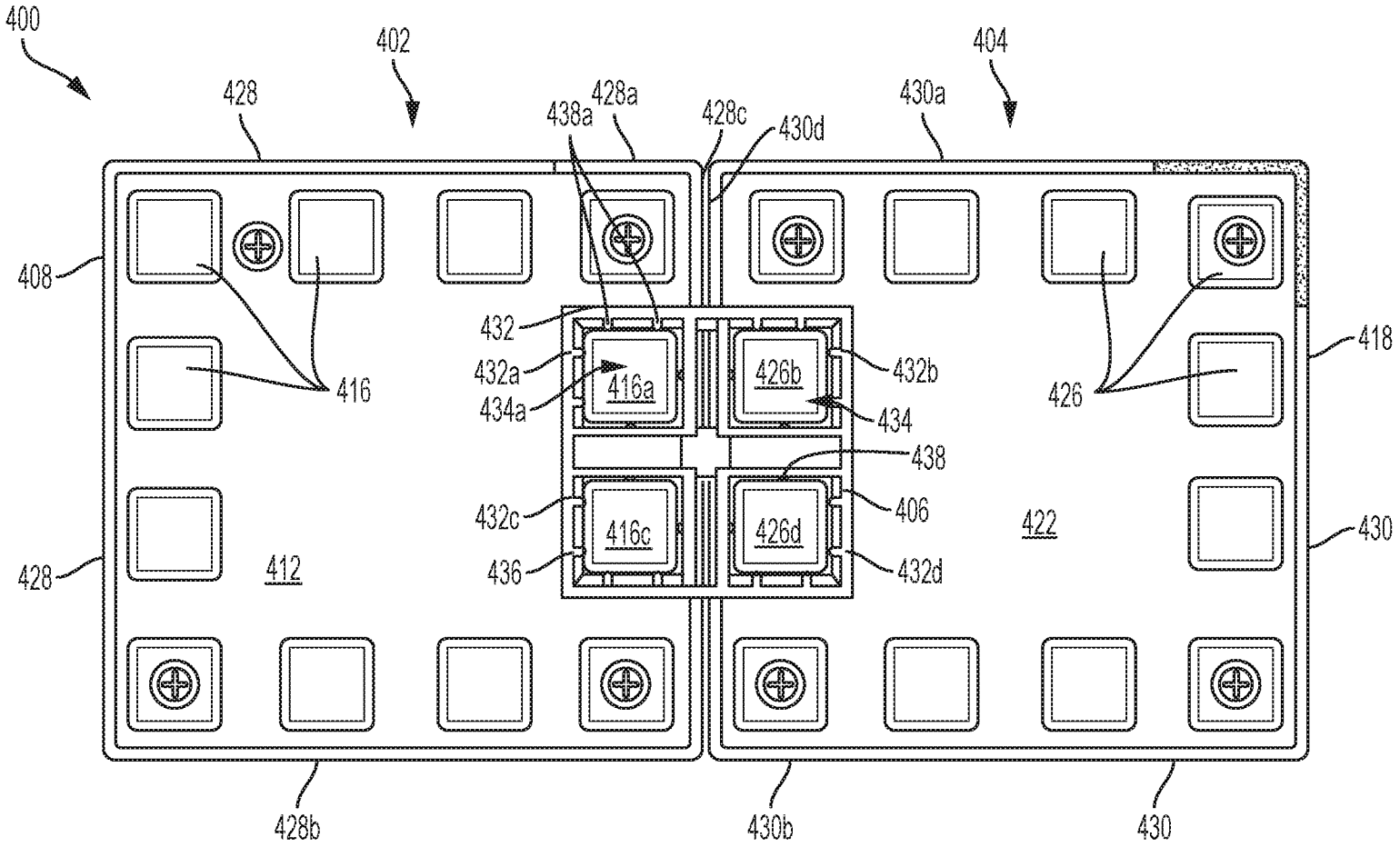
FIG. 10 is a bottom plan view of an embodiment of the toy play system of FIG. 2, showing the bases of two toy play sets coupled together by a base connector.
Figure 11:
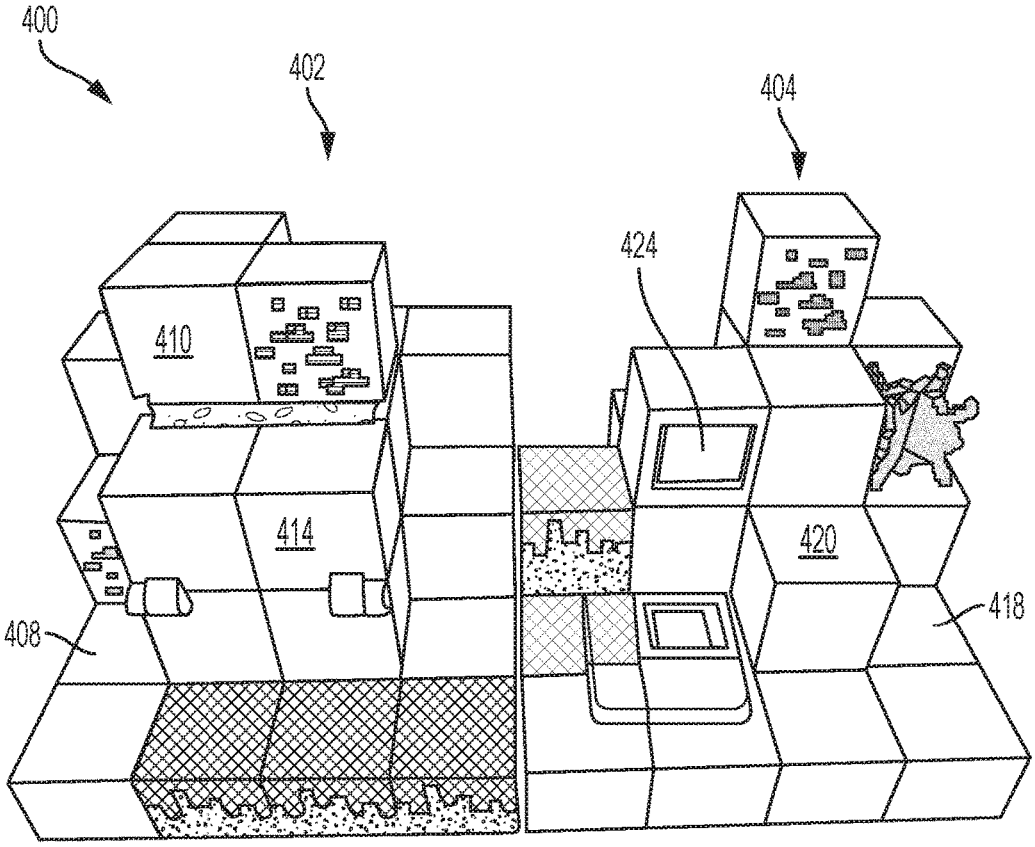
FIG. 11 is an upper front view of the two play sets coupled together of FIG. 10.

FIG. 10 is a bottom plan view of an embodiment of a toy play system, generally indicated at 400. FIG. 11 is an upper front perspective view of toy play system 400. FIGS. 10 and 11 are herein described together. Toy play system 400 is an embodiment of toy play system 100 described above, and the various features and benefits of toy play system 100 will not be repeated in their entirety.

Toy play system 400 may include a first toy play set 402, a second toy play set 404, and a base connector 406. First toy play set 402 may be similar to first toy play set 302 and/or to third toy play set 206 described above. Second toy play set 404 may be similar to second toy play set 204 described above. Base connector 406 may be similar to base connector 338 and/or base connector 210, both of which are described above.

First toy play set 402 may have a first base 408. First base 408 may include a first upper portion or side 410 and a first lower portion 412 or side opposed to the first upper portion. The first upper portion may include at least one first play feature 414. The first lower portion may include a plurality of first protrusions 416.

Second toy play set 404 may have a second base 418. Second base 418 may include a second upper portion or side 420 and a second lower portion 422 or side opposed to the second upper portion. The second upper portion may include at least one second play feature 424. The second lower portion may include a plurality of second protrusions 426.

The second lower portion 422 of second base may be substantially identical to the first lower portion 412 of first base 408, both of which may be similar to the lower portion 308 described in Example 3 above. The various details and features of lower portion 308 will not be repeated. However, features of lower portion 308 which are common to first lower portion 412 and second lower portion 422 are given similar names herein, but for the modifiers of "first" and "second" for purposes of clarity. That is, statements about an arbitrary element of lower portion 308 may equally apply to the corresponding arbitrary elements of first lower portion 412 and second lower portion 422. For example, lower portion 308 may include a plurality of edges 314 shown in FIG. 4, while first lower portion 412 may include a plurality of first edges 428 substantially similar to edges 314 and second lower portion 422 may also include a plurality of second edges 430 substantially similar to edges 314, etc.

Base connector 406 may have at least two coupling structures 432. One coupling structure, denoted 432*a* in FIG. 10, of the at least two coupling structures may be configured to be coupled with a first protrusion, denoted as 416*a*, of the plurality of first protrusions 416 to secure base connector 406 to first toy play set 402. Another coupling structure, denoted as 432*b*, of the at least two coupling structures 432 may be configured to be coupled with a second protrusion, denoted as 426*b*, of the plurality of second protrusions to secure base connector 406 to second toy play set 404. That is, base connector 406 may facilitate securing first toy play set 402 to second toy play set 404.

Another coupling structure 432*c* of the at least two coupling structures 432 may be configured to be coupled to another first protrusion, denoted as 416*c*, of the plurality of first protrusions, with first protrusion 416*c* adjacent to first protrusion 416*a*. Another coupling structure 432*d* of the at least two coupling structures 432 may be configured to be coupled to another second protrusion, denoted as 426*d*, of the plurality of second protrusions, with second protrusion 426*d* adjacent to second protrusion 426*b*. Although the base connector is shown to have coupling structures configured to be coupled to adjacent protrusions, the base connector may, in some embodiments, include coupling structures that are configured to be coupled to non-adjacent protrusions of the same toy play set.

First toy play set 402 and second toy play set 404 are shown in FIG. 10 as coupled to one another via base connector 406. The configuration shown in FIG. 10 may be described as a flush-joined configuration, as a first edge 428*a* of the plurality of first edges 428 may be substantially aligned with a second edge 430*a* of the plurality of second edges while another first edge 428*b* opposite first edge 428*a* may be substantially aligned with another second edge 430*b* opposite second edge 430*a*. In the flush-joined configuration, another first edge 428*c* which extends between first edges 428*a* and 428*b* may be proximate and/or contact another second edge 430*d* which extends between second edges 430*a* and 430*b* along a full length of first edge 428*c* and along a full length of second edge 430*d*.

There may be many other possible flush-joined configurations for the first and second toy play sets 402 and 404. One other possible flush-joined configuration may include the first and second toy play sets having the relative disposition shown in FIG. 10, but with base connector 406 rotated clockwise 90 degrees relative to the orientation shown in FIG. 10. That is, each of the at least two coupling structures 432 may include an aperture 434 sized to receive either (a) a first protrusion of the plurality of first protrusions 416 or (b) a second protrusion of the plurality of second protrusions 426. For example, coupling structure 432*a* may include aperture 434*a* which may be sized to receive either first protrusion 416*a* or second protrusion 426*b* or other first or second protrusions. Many other flush-joined configurations may be possible by further rotations of base connector 406 or by rotating the base connector by one hundred eighty degrees about an axis vertical in the view of FIG. 10, that is, by turning the base connector over.

Base connector 406 may include a frame 436 having the at least two coupling structures 432. Frame 436 may include a plurality of spaced ribs 438 around each aperture 434. The plurality of spaced ribs may be configured to frictionally engage either (a) a first protrusion of the plurality of first protrusions 416 or (b) a second protrusion of the plurality of second protrusions 426. For example, aperture 434*a* may have ribs 438*a* spaced around the aperture and ribs 438*a* may be configured to frictionally engage either first protrusion 416*a* or second protrusion 426*b* or any other of the first or second protrusions.

Other flush-joined configurations for the first and second toy play sets 402 and 404 are also possible with base connector 406. For example, base connector 406 may be shifted up or down relative to the position of the base connector shown in FIG. 10 and still secure the first and second toy play sets to one another. Base connector 406 may be shifted up or down by one or two units relative to the position of the base connector shown in FIG. 10 and still function to secure the first and second toy play sets to one another. In other examples, two base connectors may be used to secure the first and second toy play sets to one another, with the two base connectors vertically adjacent to one another in the view of FIG. 10.

Still other flush-joined configurations for the first and second toy play sets 402 and 404 are also possible through different arrangements of the first and second toy play sets themselves. In some examples, first toy play set 402 may be rotated clockwise ninety degrees relative to the position shown in FIG. 10 so that first edge 428*a* is proximate second edge 430*d*. In some examples, second toy play set 404 may be rotated clockwise ninety degrees relative to the position shown in FIG. 10 so that second edge 430*b* is proximate first edge 428*c*. As first base 408 and second base 418 both have four edges, there may be sixteen different possible flush-joined configurations achieved by varying the relative dispositions of the first and second toy play sets. As can be appreciated by viewing FIG. 11, this may result in a large variety of varying play surfaces for a user of system 400.

In some examples, when the first and second toy play sets 402 and 404 are supported by their respective lower sides 412 and 422 on a flat support surface and the first and second toy play sets are coupled together by base connector 406, some or all of the first and second protrusions 416 and 422 may contact the support surface. In particular, protrusions 416*a*, 416*c*, 426*b*, and 426*d* may contact the support surface when first toy play set 402 is coupled to second toy play set 404 via base connector 406. Each of the protrusions 416 and 426 may have a height (shown, for example, at 322 in FIG. 3) which may be more than, less than, or equal to a thickness (shown, for example, at 357 in FIG. 5). Thus, the first and second toy play sets may sit level on a support surface (as shown, for example, in FIG. 11) when coupled together by base connector 406 or when not coupled to one another.

Figure 12:
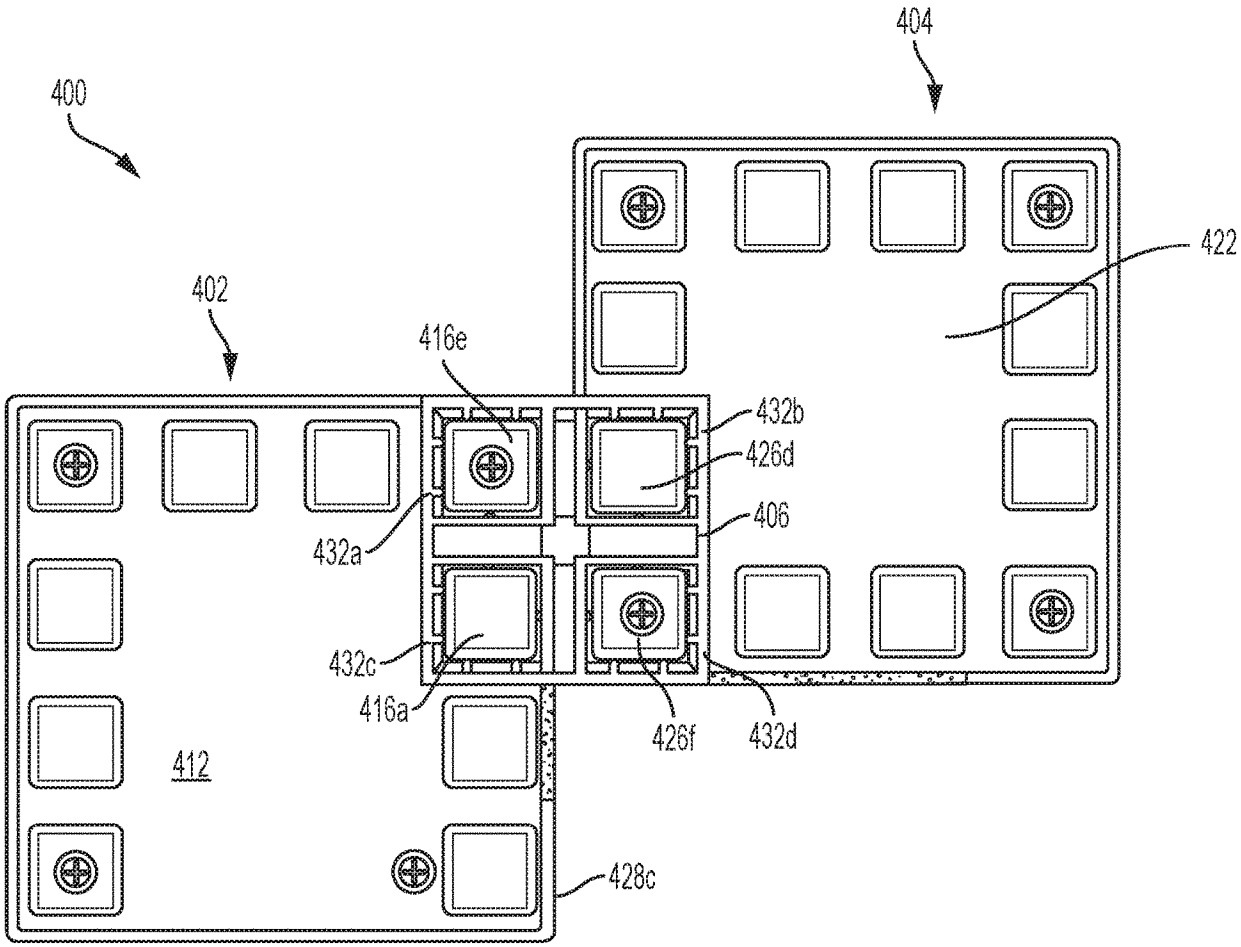
FIG. 12 is a bottom plan view of the toy play system of FIG. 10, showing the two bases obliquely coupled together by a base connector.
Figure 13:
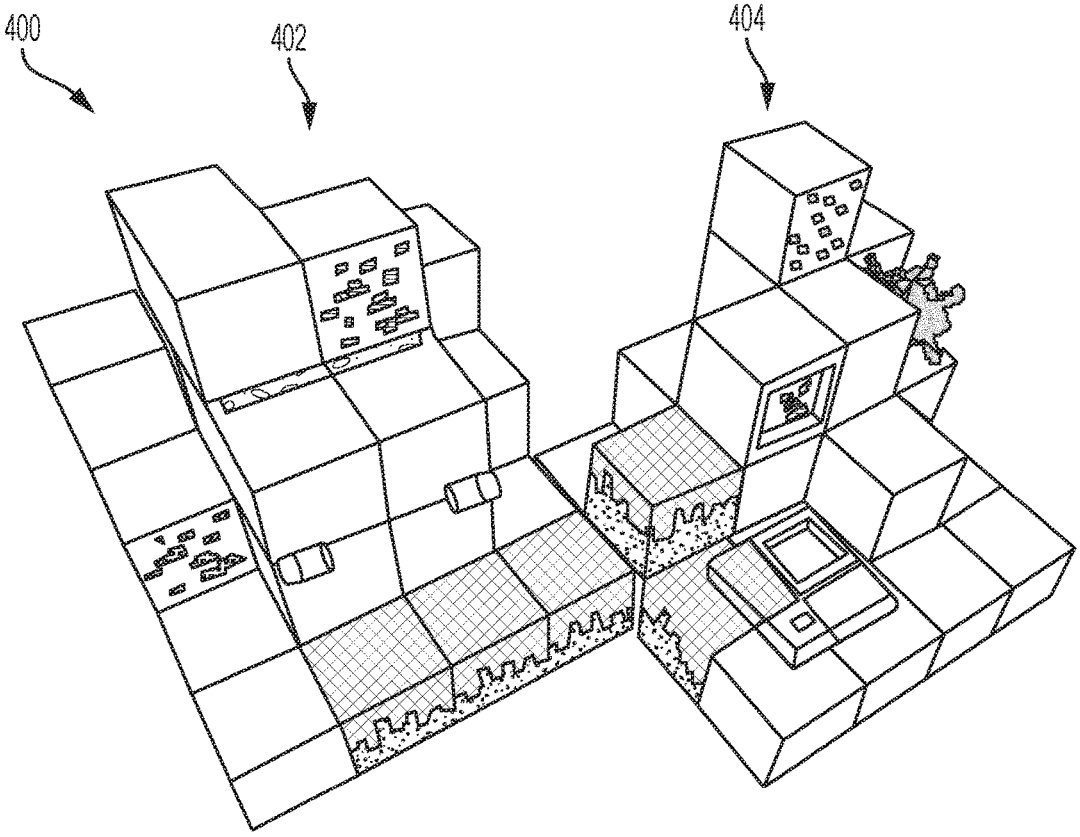
FIG. 13 is a front view of the two bases of FIG. 12.

FIG. 12 is a bottom plan view of toy play system 400, showing first toy play set 402 coupled to second toy play set 404 by base connector 406. FIG. 13 is a front perspective view of the first and second toy play sets 402 and 404 coupled together. FIGS. 12 and 13 are herein described together. The configuration shown in FIGS. 12 and 13 may be described as an obliquely-joined configuration.

In the obliquely-joined configuration shown in FIGS. 12 and 13, coupling structure 432*a* frictionally engages a first protrusion 416*e* which may be proximate an upper-right corner of first lower side 412, coupling structure 432*b* frictionally engages second protrusion 426*d*, coupling structure 432*c* frictionally engages first protrusion 416*a*, and coupling structure 432*d* frictionally engages a second protrusion 426*f* which may be proximate a lower-left corner of second lower side 422. As will be appreciated, many more obliquely-joined configurations are possible by having more or less overlap between first edge 428*c* and second edge 430*d*, by rotating either or both of the first and second toy play sets 402 and 404, or by rotating or translating base coupler 406 relative to the position shown in FIG. 12.

Example 5

Figure 14:
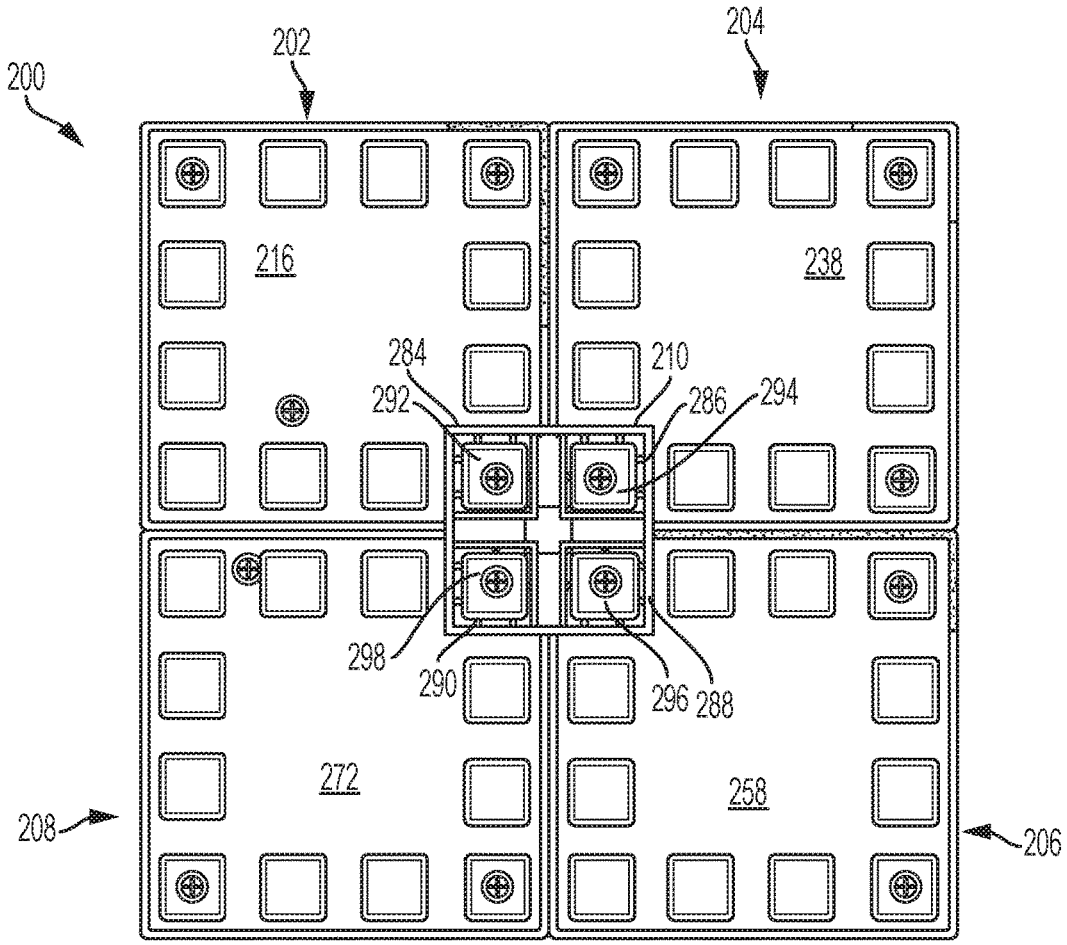
FIG. 14 is a bottom plan view of the toy play system of FIG. 2, showing the bases of four toy play sets coupled together by a single base connector.
Figure 15:
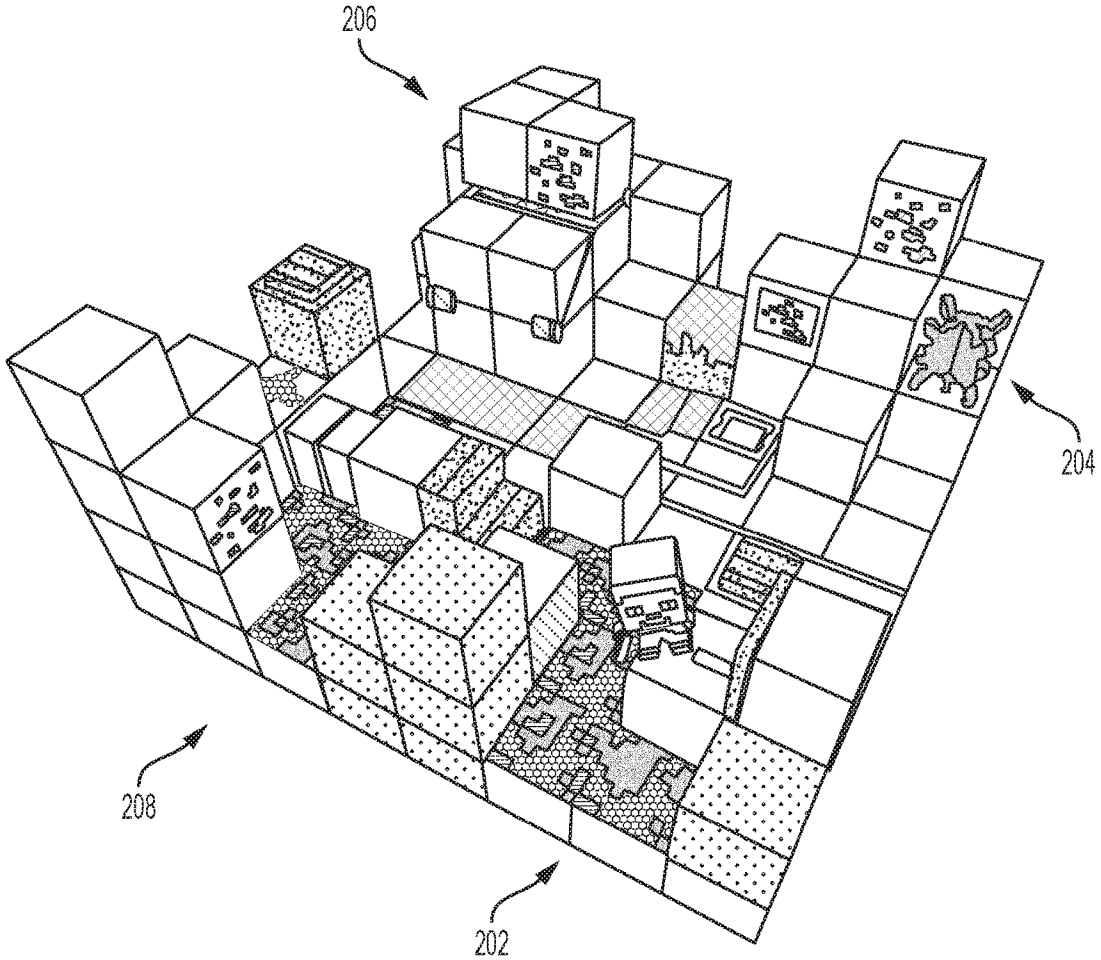
FIG. 15 is a perspective view of the four bases of FIG. 14.

This example describes illustrative toy play system 200 described above, including four toy play sets and a base connector, see FIGS. 14 and 15.

FIG. 14 is a bottom plan view of toy play system 200, showing the first toy play set 202, the second toy play set 204, the third toy play set 206, the fourth toy play set 208, and base connector 210 in a four-base configuration. FIG. 15 is an upper perspective view of toy play system 200 in a four-base configuration. FIGS. 14 and 15 are herein described together. Base connector 210 may be substantially similar to base connector 338 described above. Base connector 210 may include a first coupling structure 284, a second coupling structure 286, a third coupling structure 288, and a fourth coupling structure 290.

In the four-base configuration shown in FIG. 14, first coupling structure 284 frictionally engages a first protrusion 292 of first lower side 216, second coupling structure 286 frictionally engages a second protrusion 294 of second lower side 238, third coupling structure 288 frictionally engages a third protrusion 296 of third lower side 258, and fourth coupling structure 290 frictionally engages a fourth protrusion 298 of fourth lower side 272. Each of the first, second, third, and fourth protrusions may be disposed proximate a respective corner of the first, second, third, and fourth lower sides. In some examples, the first and second coupling structures may be described as being in a first end portion of the base connector, while the third and fourth coupling structures may be described as being in a second end portion of the base connector.

As will be appreciated, many more four-base configurations are possible, by rotating base connector 210, flipping base connector 210 over, using more than one base connector, or by rotating any of the four play sets 202, 204, 206, and 208 relative to one another. Just considering ninety degree rotations of the four play sets, two hundred fifty-six separate and distinct four-base configurations may be possible.

As will further be appreciated, many configurations including only three toy play sets are also possible using one or more base connectors. Indeed, given the modular nature of the lower portions of the bases and the base connectors, there may be only practical limits to how many toy play sets of this nature that can be coupled to one another.

Example 6

This example describes illustrative toy play features and/or internal components of illustrative toy play features of toy play sets as described above; see FIGS. 16-21.

Figure 16:
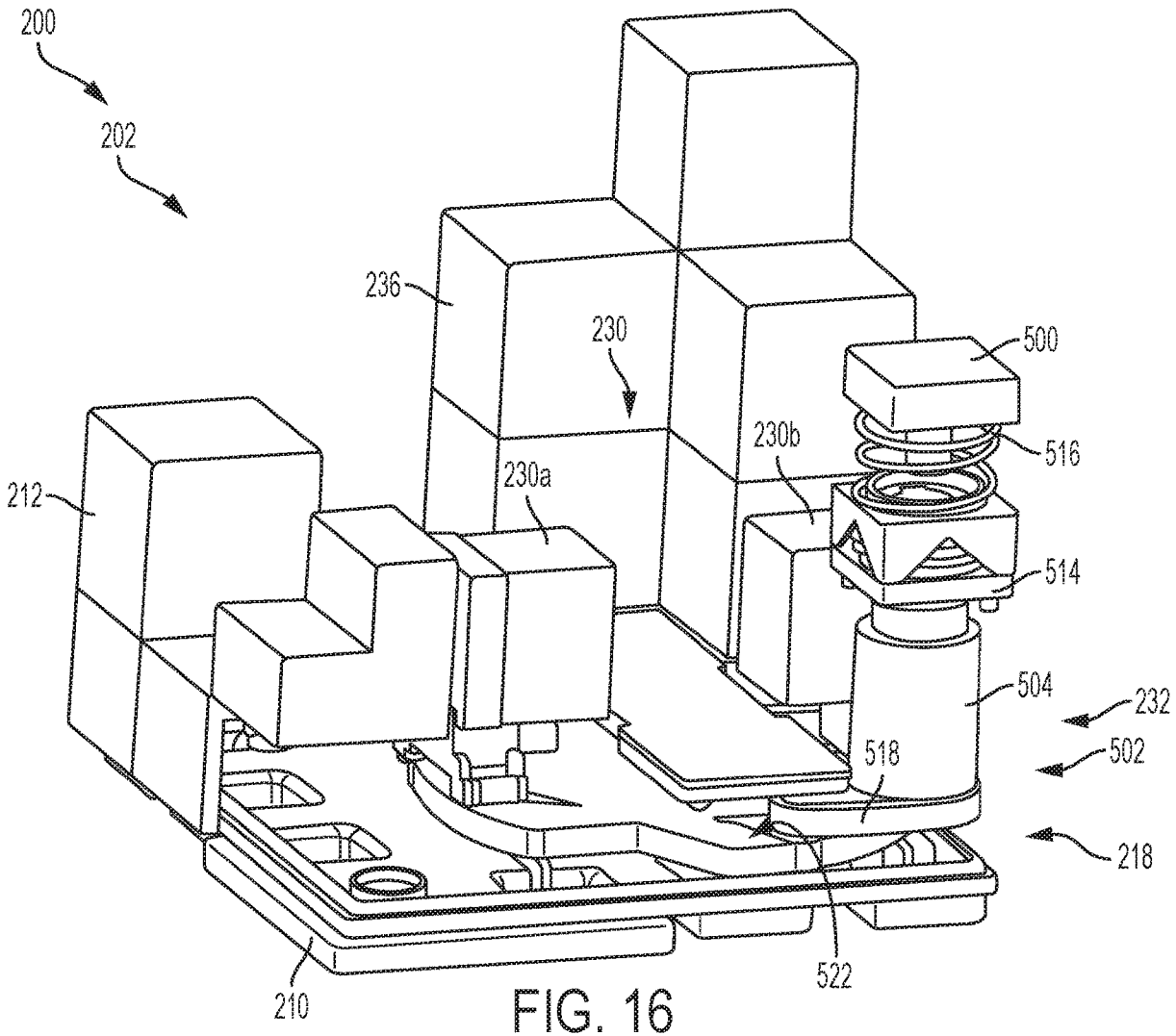
FIG. 16 is an upper isometric view of a toy play set of FIG. 2 having an extendable bridge, with portions of the toy play set removed in order to show internal components of a play feature.
Figure 17:
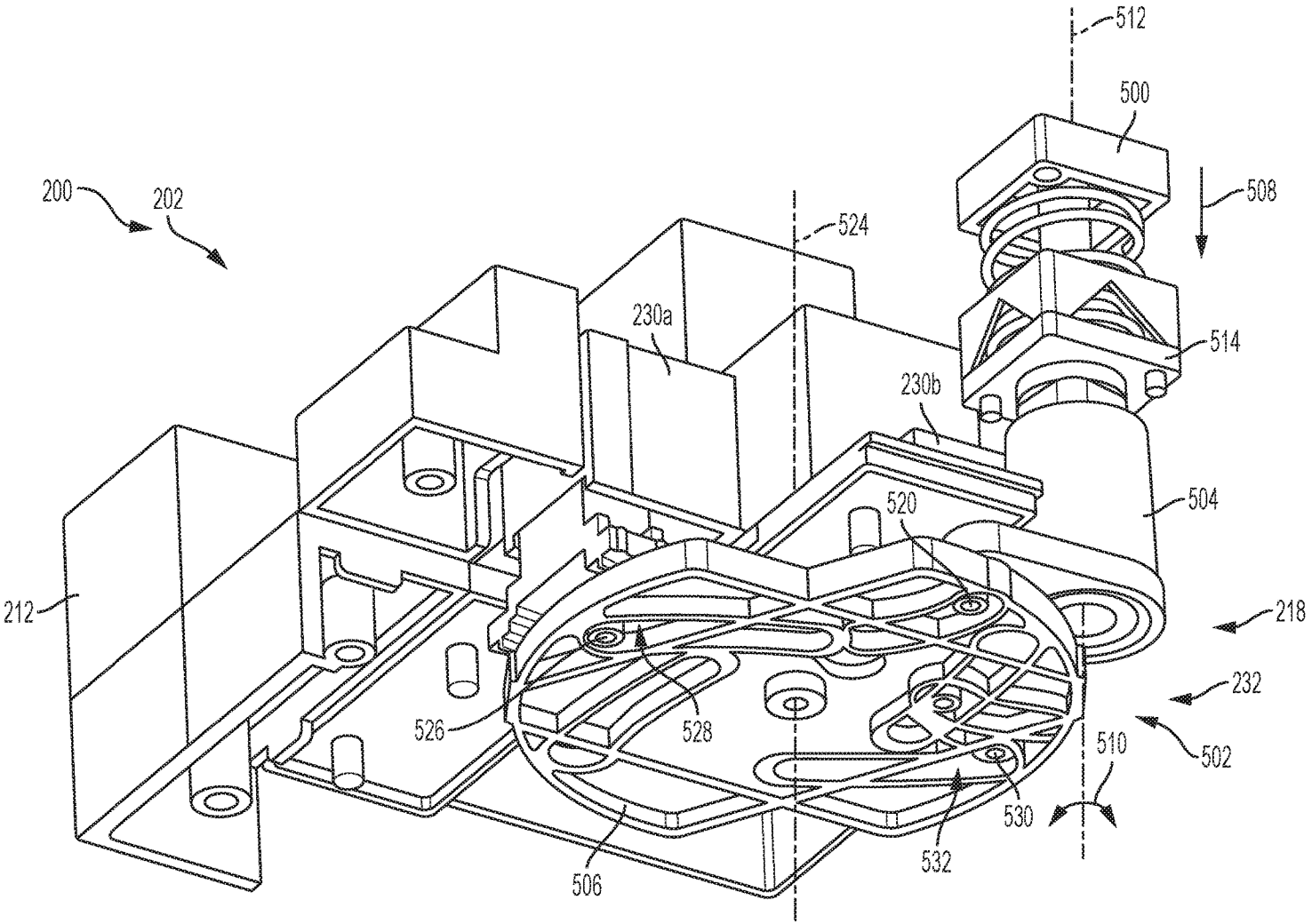
FIG. 17 is a lower isometric view of the toy play set of FIG. 16, with portions of the toy play set removed in order to show a rotatable plate having a plurality of curved slots.

FIG. 16 is an upper isometric view of toy play system 200, in particular of first toy play set 202 and a base connector 210. First base 212 is rotated by roughly ninety degrees relative to the view shown in FIG. 2, and sections of first upper portion 214 are removed or transparent in order to show internal components of first play feature 218. FIG. 17 is a lower isometric view of toy play set 202, with the first lower portion removed or transparent and sections of the first upper portion removed or transparent. FIGS. 16 and 17 are herein described together.

Base connector 210 is shown in FIG. 16 in a storage configuration as described above. It will be appreciated that at least the end surfaces (shown at 316 in FIG. 3) of the protrusions which are coupled to the base connector may extend through the apertures (shown at 346 in FIG. 5) and may make contact with a support surface on which first toy play set 202 is supported.

As described above, first play feature 218 may include a bridge 230 and a mechanism 232 which may include a triggering button 500. Bridge 230 may include a first bridge portion 230*a* and a second bridge portion 230*b*. The first and second bridge portions may have an extended position (shown, for example, in FIG. 2) and a retracted position (shown, for example in FIG. 16). Mechanism 200 may further include a set of first internal components 502 which may be largely hidden from view.

The set of first internal components 502 may include an actuator 504 and a rotatable plate 506. Depressing triggering button 500 in a vertical direction 508 may cause actuator 504 to rotate in an angular direction, indicated at curved arrow 510, around a first rotation axis 512 parallel to direction 508. Internal components 502 may include a rotation direction alternator 514. During repeated depression of button 500, rotation direction alternator 514 may cause actuator 504 to alternately rotate in a clockwise and then a counterclockwise direction. A first spring 516 may return button 500 to an up position subsequent to depression of button 500 by a user.

Actuator 504 may include a first arm 518 which may be coupled to rotatable plate 506 via a first post 520 extending through an aperture 522 in the rotatable plate. Rotation of actuator 504 about the first rotation axis 512 may cause rotation of rotatable plate 506 about a second rotation axis 524 parallel to and spaced from first rotation axis 512. Clockwise rotation of actuator 504 may be correlated with counterclockwise rotation of rotatable plate 506 and counterclockwise rotation of actuator 504 may be correlated with clockwise rotation of rotatable plate 506.

Rotatable plate 506 may be coupled to first bridge portion 230*a* by a first bridge post 526 which is connected to first bridge portion 230*a* and which extends through a first slot 528 in the rotatable plate. First slot 528 may be an elongate slot and may extend both toward and around second rotation axis 524. First bridge post 526 may be constrained to move within first slot 528 so that a rotation of rotatable plate 506 around the second rotation axis 524 may result in a linear translation of first bridge portion 230*a*. Repeated depression of triggering button 500 may move first bridge portion 230*a* between the retracted position and the extended position and vice-versa.

Rotatable plate 506 may be coupled to second bridge portion 230*b* by a second bridge post 530 which is connected to second bridge portion 230*b* and which extends through a second slot 532 in the rotatable plate. Second slot 532 may be an elongate slot and may extend both toward and around second rotation axis 524. Second bridge post 530 may be constrained to move within second slot 532 so that a rotation of rotatable plate 506 around the second rotation axis 524 may result in a linear translation of second bridge portion 230*b*. Repeated depression of triggering button 500 may move second bridge portion 230*b* between the retracted position and the extended position and vice-versa.

Figure 18:
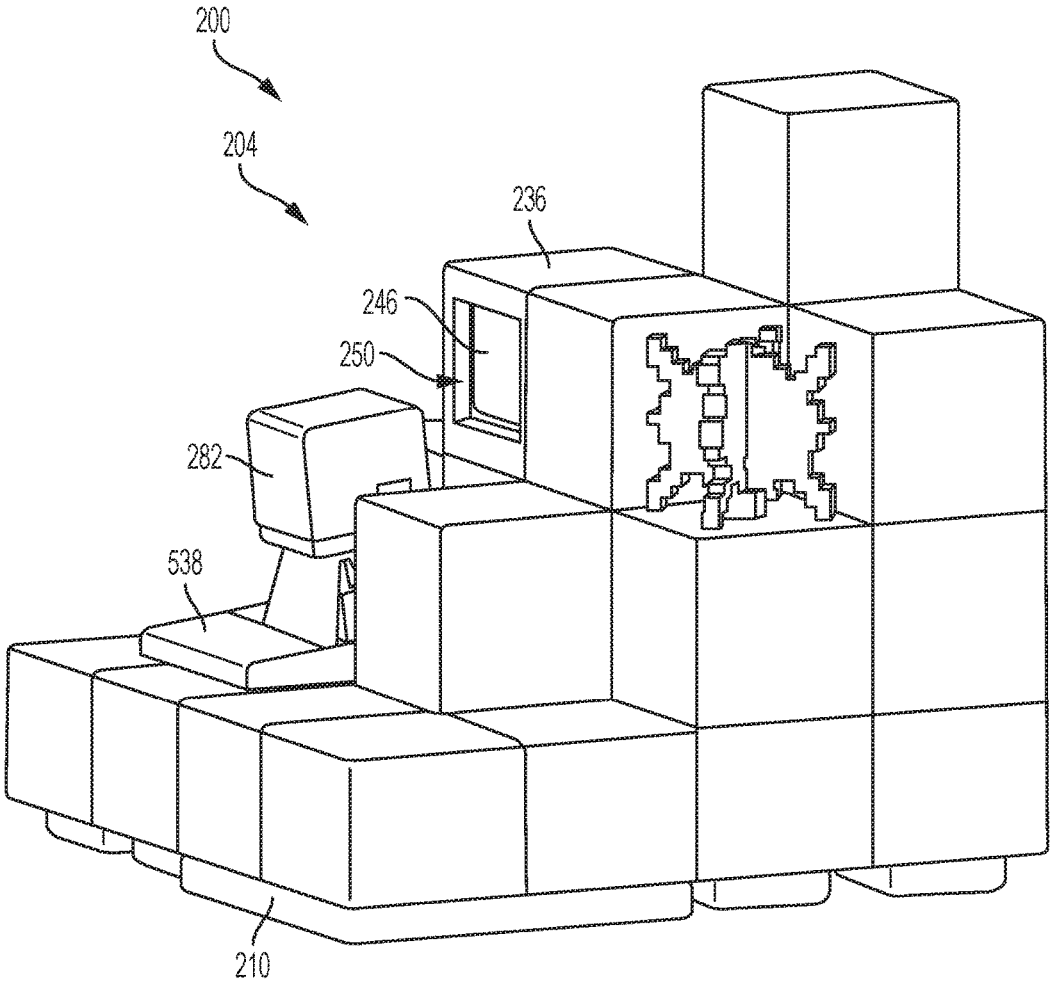
FIG. 18 is an isometric view of another toy play set of FIG. 2, the toy play set having a rotatable panel.
Figure 19:
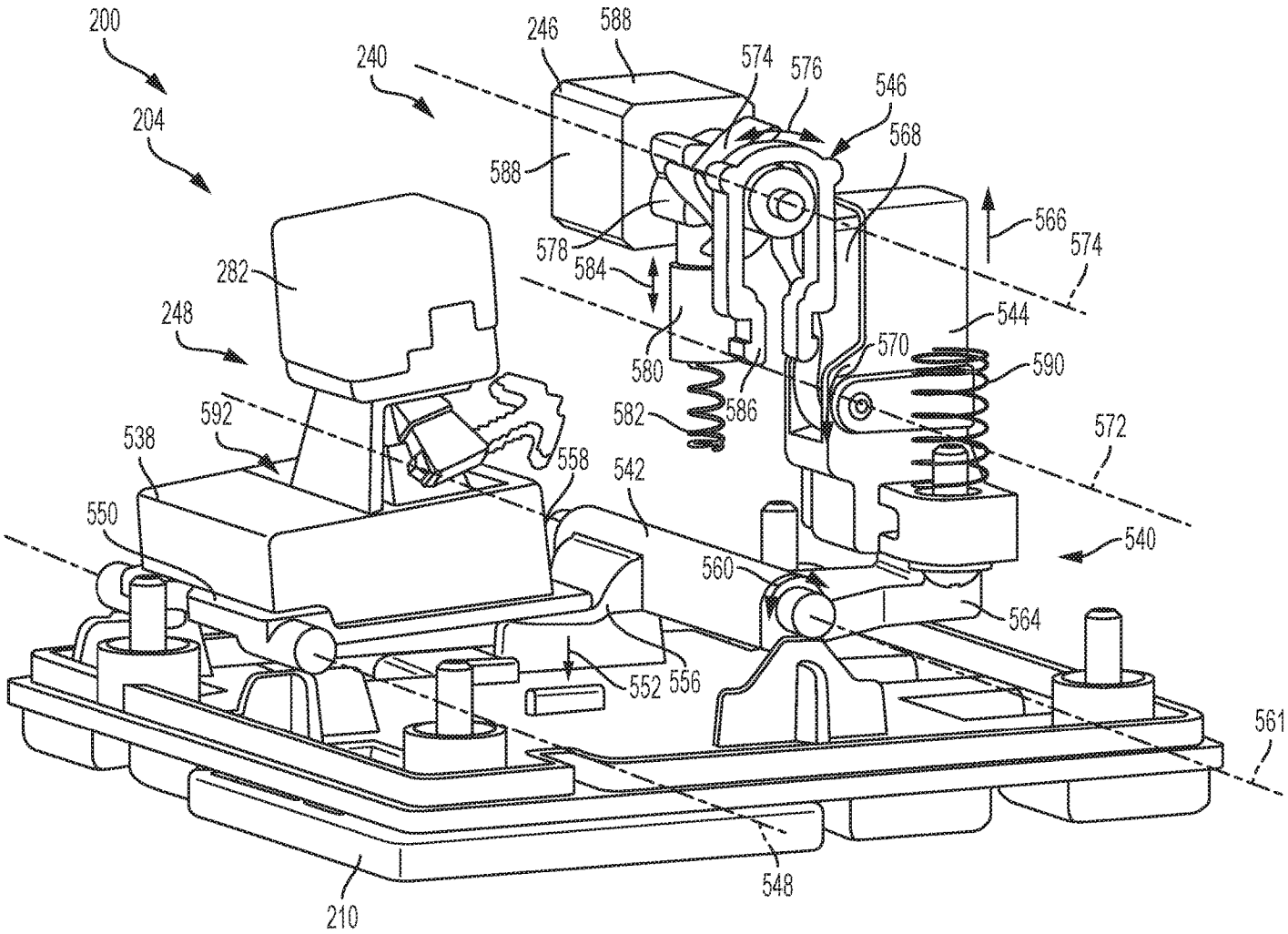
FIG. 19 is an isometric view of the toy play set of FIG. 18, with portions of the toy play set removed in order to show internal components of a play feature.

FIG. 18 is an isometric view of toy play system 200, in particular of second toy play set 204 and a base connector 210. FIG. 19 is an isometric view of second toy play set 204 with sections of second upper portion 236 removed or transparent in order to show internal components of second play feature 240. FIGS. 18 and 19 are herein described together.

As described above, second play feature 240 may include a panel 246 and a mechanism 248 configured to move panel 246 among a plurality of positions. Mechanism 248 may include a triggering button 538 and panel 246 may be visible through an aperture 250 in second upper portion 236. Mechanism 248 may further include a set of second internal components 540 which may be largely hidden from view.

Internal components 540 may include a rotatable lever 542, a translatable follower 544, and a ratcheting member 546. Triggering button 538 may be a rotatable button having a first rotation axis 548 at a first end 550 of the button. Pressing button in a downward direction, indicated by downward arrow 552, may cause button 538 to rotate in a clockwise direction in the view of FIG. 19 around first rotation axis 548.

Triggering button 538 may interact with a first lever arm 556 of rotatable lever 542 proximate a second end 558 of the button. Depressing the button in direction 552 may cause a counterclockwise rotation (in the view of FIG. 19) of rotatable lever 542, as indicated by curved arrow 560, about a second rotation axis 561 spaced from and parallel to first rotation axis 548. Rotatable lever 542 may have a second lever arm 564 opposite first lever arm 556. Rotation of rotatable lever 542 in direction 560 may cause an upward movement, indicated by upward arrow 566, of second lever arm 564. Upward movement of the second lever arm may cause upward movement of translatable follower 544.

Translatable follower 544 may be configured to move up and down and may cause ratcheting member 546 to cycle through a plurality of positions. Translatable member 544 may include a pushing arm 568 which may be configured to interact with ratcheting member 546. As the translatable follow moves in the upward direction 566, pushing arm 568 may rotate in a counterclockwise direction, indicated by curved arrow 570, about a third rotation axis 572 which may be parallel to and spaced from second rotation axis 560. That is, pushing arm 568 may simultaneously move vertically and rotate as second lever arm 564 moves in an upward direction. The rotation of the pushing arm may facilitate the pushing arm maintaining contact with ratcheting member 546.

Upward movement of translatable follower 544 may cause rotation of ratcheting member 546 in a counterclockwise direction (in the view of FIG. 19) around a fourth rotation axis 574 as indicated by curved arrow 576. Ratcheting member 546 may be coupled to panel 246 so that rotation of the ratcheting member is also rotation of the panel. Panel 246 may have a toothed portion 578 configured to interact with a pawl member 580. Pawl member 580 may be urged in a vertical direction by a pawl spring 582. Pawl member 580, pawl spring 582, and toothed portion 578 of panel 246 may be configured so that panel 246 may rest securely in a discrete plurality of positions relative to upper portion 236. As panel 246 moves between a first secure position and a second secure position, pawl member 580 may first move downward as urged by the toothed portion 578 and then upward as urged by pawl spring 582, as indicated by two-sided arrow 584. Upward movement of ratcheting member 546 may be prevented by a retainer clip 586 which may be otherwise secured to upper portion 536.

Panel 246 may have a plurality of faces 588 which may alternately be displayed through aperture 250 when panel 246 is secured in the discrete plurality of positions by pawl member 580. Faces 588 may accommodate stickers or other visual indications or textures so that panel 246 may have a plurality of visual appearances through aperture 250. Repeated depression of triggering button 538 may cycle panel 246 through the plurality of visual appearances. Internal components 540 may include a return spring 590 configured to return mechanism 248 to a resting state in which button 538 is not depressed.

Triggering button 538 may include an aperture 592 sized to receive figurine 282 described above.

Figure 20:
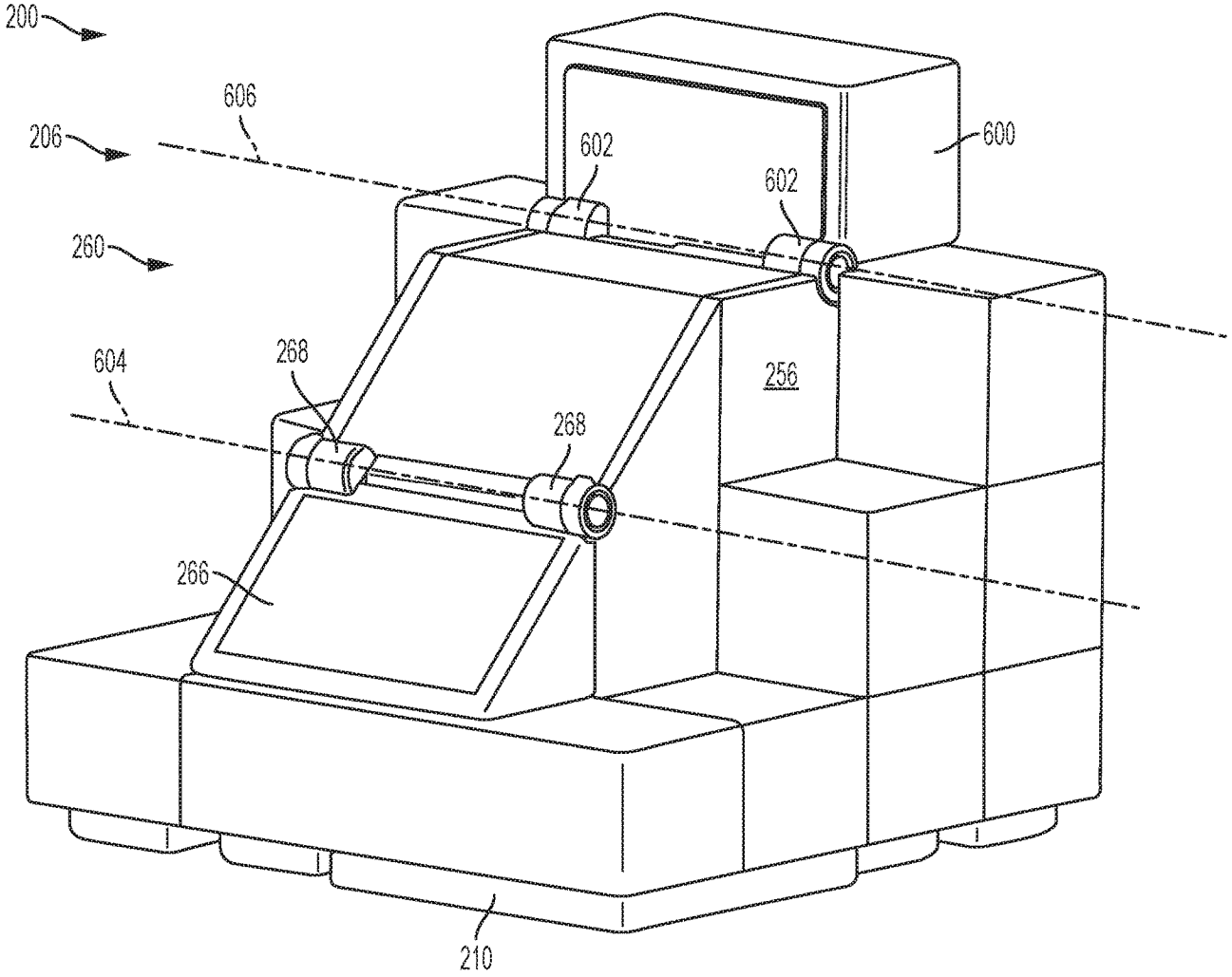
FIG. 20 is an isometric view of another toy play set of FIG. 2, the toy play set having two portions which are independently rotatable with respect to the remainder of the toy play set.

FIG. 20 is an isometric view of toy play set 206 and base connector 210 of toy play system 200. As described above, third play feature 260 may include a manual flip down section 266 coupled to the rest of third upper portion 256 via hinge 268. Flip down section 266 is shown in a down position in FIG. 20 and an up position in FIG. 2.

Third toy play set 206 may include a second manual flip section 600 which may be configured to rotate relative to the remainder of third upper portion 256 via a hinge 602. Second manual flip section 600 may include one or more whole blocks or portions of blocks. In the embodiment shown in FIG. 20, manual flip down section 266 is configured to rotate about a first rotation axis 604 and second manual flip section 600 is configured to rotate about a second rotation axis 606, which is parallel to and spaced from the first rotation axis 604. However, in other embodiments the first and second rotation axes need not be parallel to one another or even lie in a common plane.

Figure 21:
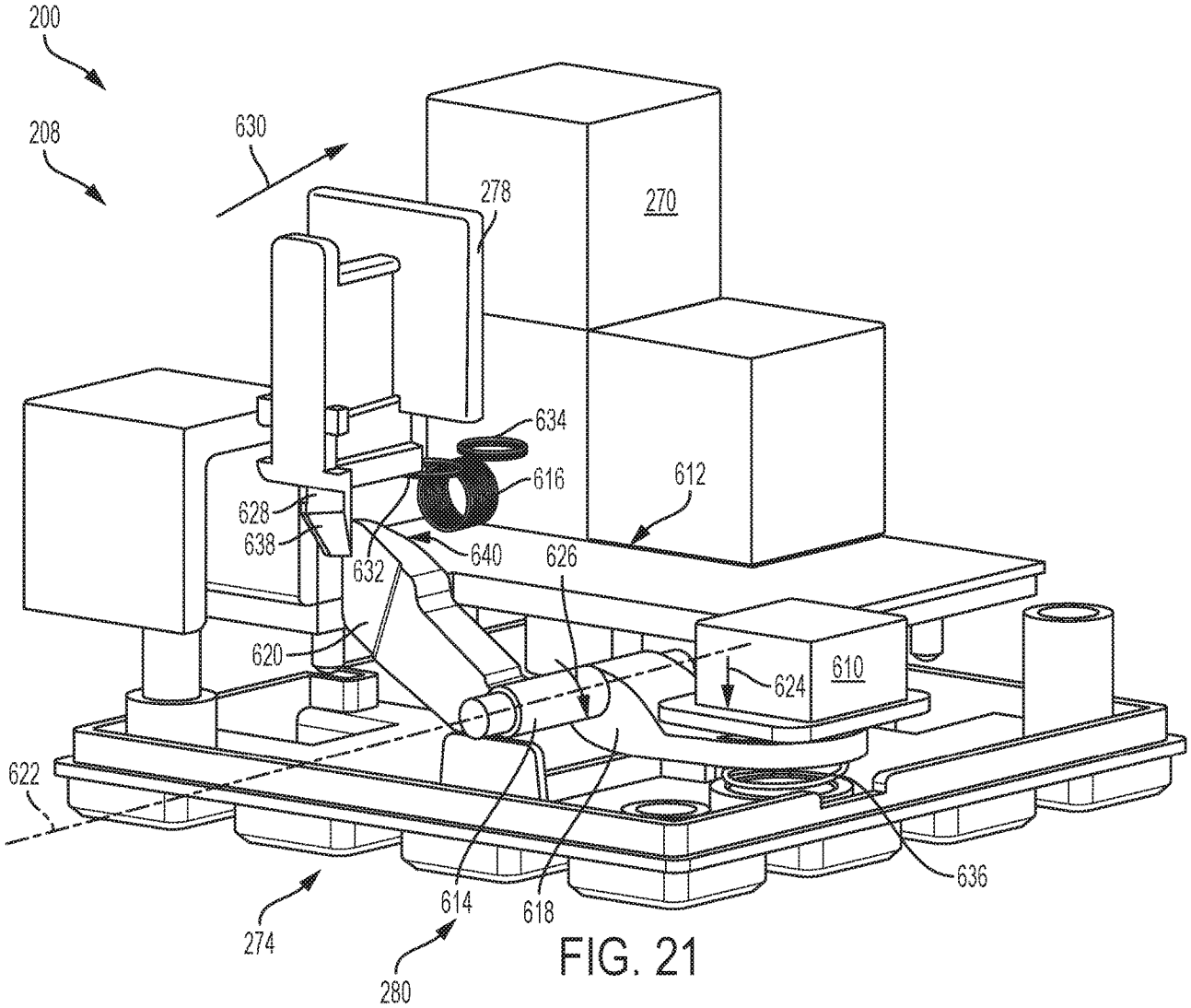
FIG. 21 is an isometric view of another toy play set of FIG. 2, the toy play set having a movable wall, with portions of the toy play set removed in order to show internal components of a play feature.

FIG. 21 is an isometric view of toy play set 208 of toy play system 200. Sections of fourth upper portion 270 are removed or transparent in FIG. 21 in order to show internal components of fourth play feature 274. Toy play set 208 is rotated by roughly ninety degrees relative to the view shown in FIG. 2.

As described above, fourth play feature 274 may include a wall 278 movably connected to fourth upper side 270 and a mechanism 280 which may be configured to move wall 278 from a retracted position toward an extended position. Mechanism 280 may include a triggering button 610. Mechanism 280 may further include a set of fourth internal components 612 which may be largely hidden from view within the fourth upper portion.

Fourth internal components 612 may include a rotatable lever 614 and a launching spring 616. Rotatable lever 614 may have a first arm 618 configured to engage with triggering button 610 and a second arm 620 opposite first arm 618 configured to engage with wall 278. Rotatable lever 614 may be configured to rotate around a first rotation axis 622.

Depressing triggering button 610 in a downward direction, indicated by downward arrow 624, may cause rotatable lever 614 to rotate in a clockwise direction (as viewed in FIG. 21) about first rotation axis 622, as indicated by curved arrow 626. Clockwise rotation of rotatable lever 614 may cause second arm 620 to disengage from a lower catch portion 628 of wall 278. Disengagement of the second arm and the lower catch portion may allow wall 278 to move in a lateral direction, indicated by arrow 630, at the urging of launching spring 616.

Launching spring 616 may have a first end 632 coupled to wall 278 and a second end 634 coupled to upper portion 270. The connection between the second end of the spring and the upper portion may be any appropriate connection, and it will be appreciated that an attachment point may not be visible in FIG. 21 as sections of upper portion are transparent in the view of FIG. 21. When wall 278 is in the retracted position, launching spring 616 may be in an extended position. When wall 278 is in an extended position, launching spring may be in a less-extended position.

After wall 278 has been released to move along direction 630 by second arm 620, a return spring 636 may return rotatable lever 614 and triggering button 610 to an equilibrium position. To reset wall 278 to the retracted position, as user may urge wall 278 in a direction opposite to arrow 630 against the urging of launching spring 616. So urged, a first angled surface 638 of lower catch portion 628 may contact with a second angled surface 640 of second arm 620. This contact may cause rotatable lever 614 to rotate in direction 626 until the second arm is clear of the lower catch portion and first angle surface 638 of the lower catch portion disengages from second angled surface 640 of the second arm. At this point, return spring 636 may return rotatable lever 614 to the equilibrium position where motion of wall 278 along direction 630 is prevented by second arm 620.

Example 7

This section describes additional aspects and features of toy play systems, presented without limitation as a series of paragraphs, some or all of which may be alphanumerically designated for clarity and efficiency. Each of these paragraphs can be combined with one or more other paragraphs, and/or with disclosure from elsewhere in this application, including the materials incorporated by reference in the Cross-References, in any suitable manner. Some of the paragraphs below expressly refer to and further limit other paragraphs, providing without limitation examples of some of the suitable combinations.

A1. A toy play system, comprising:

a first toy play set having a first base, the first base includes opposed upper and lower sides, the upper side includes at least one play feature, the lower side includes a plurality of protrusions; and a base connector having at least two coupling structures, one coupling structure of the at least two coupling structures frictionally engages a protrusion of the plurality of protrusions to secure the base connector to the first toy play set, and another coupling structure of the at least two coupling structures frictionally engages a second toy play set to secure the base connector to the second toy play set.

A2. The toy play system of paragraph A1, wherein the lower side is defined by a plurality of edges, wherein the plurality of protrusions are arranged along one or more of the plurality of edges.

A3. The toy play system of paragraph A2, wherein the plurality of protrusions are arranged along each of the plurality of edges.

A4. The toy play system of any of paragraphs A1-A3, wherein each protrusion of the plurality of protrusions has about the same dimensions as the other protrusions of the plurality of protrusions.

A5. The toy play system of any of paragraphs A1-A4, wherein each coupling structure of the at least two coupling structures has about the same dimensions as other coupling structures of the at least two coupling structures.

A6. The toy play system of any of paragraphs A1-A5, wherein each protrusion of the plurality of protrusions includes an end surface that is configured to engage a support surface when the first toy play set is placed on the support surface.

A7. The toy play system of paragraph A6, wherein the end surface of each protrusion of the plurality of protrusions is square-shaped.

A8. The toy play system of any of paragraphs A1-A7, wherein the lower side includes a central portion that is free from protrusions such that a gap is defined between protrusions along two opposing edges.

A9. The toy play system of any of paragraphs A1-A8, wherein the base connector includes opposed first and second end portions, the first end portion includes at least two coupling structures that frictionally engage two of the plurality of protrusions of the lower side of the first toy play set to secure the base connector to the first toy play set, and the second end portion includes at least two coupling structures that frictionally engage the second toy play set to secure the base connector to the second toy play set.

A10. The toy play system of any of paragraphs A8-A9, wherein the lower side includes a central portion that is free from protrusions such that a gap is defined between protrusions along two opposing edges.

A11. The toy play system of paragraph A10, wherein, when the base connector does not frictionally engage the second toy play set, the gap is sized to receive one of the first and second end portions of the base connector when the at least two coupling structures of the other of the first and second end portions frictionally engage two of the plurality of protrusions of the lower side of the first toy play set.

A12. The toy play system of any of paragraphs A1-A9, wherein the at least two coupling structures of the first end portion frictionally engages two adjacent protrusions of the plurality of protrusions along the same edge of the lower side of the first toy play set.

A13. The toy play system of any of paragraphs A1-A12, wherein the base connector includes a frame having the at least two coupling structures.

A14. The toy play system of paragraph A9, wherein each of the at least two coupling structures includes an aperture sized to receive a protrusion of the plurality of protrusions.

A15. The toy play system of paragraph A13, wherein the frame includes a plurality of spaced ribs around each aperture.

A16. The toy play system of any of paragraphs A1-A15, wherein the at least one play feature includes at least one component that is movably connected to the upper side.

A17. The toy play system of paragraph A16, wherein the at least one component includes a bridge movably connected to the upper side, and the at least one play feature further includes a mechanism configured to move the bridge between extended and retracted positions.

A18. The toy play system of any of paragraphs A16-A17, wherein the at least one component includes a panel movably connected to the upper side.

A19. The toy play system of paragraph A18, wherein the at least one play feature further includes a mechanism configured to move the panel among a plurality of positions.

A20. The toy play system of any of paragraphs A16-A19, wherein the at least one component includes a wall movably connected to the upper side, and the at least one play feature further includes a mechanism configured to move the wall from a retracted position toward an extended position.

B1. A toy play system, comprising:

a first toy play set having a first base, the first base includes opposed first upper and lower portions, the first upper portion includes at least one first play feature, the first lower portion includes a plurality of first protrusions;

a second toy play set having a second base, the second base includes opposed second upper and lower portions, the second upper portion includes at least one second play feature, the second lower portion includes a plurality of second protrusions; a base connector having at least two coupling structures, one coupling structure of the at least two coupling structures is configured to be coupled with a first protrusion of the plurality of first protrusions to secure the base connector to the first toy play set, and another coupling structure of the at least two coupling structures is configured to be coupled with a second protrusion of the plurality of second protrusions to secure the base connector to the second toy play set.

B2. The toy play system of paragraph B1, wherein the first lower portion is defined by a plurality of first edges, wherein the plurality of first protrusions are arranged along one or more of the plurality of first edges, and wherein the second lower portion is defined by a plurality of second edges, wherein the plurality of second protrusions are arranged along one or more of the plurality of second edges.

B3. The toy play system of paragraph B2, wherein the plurality of first protrusions are arranged along each of the plurality of first edges, and the plurality of second protrusions are arranged along each of the plurality of second edges.

B4. The toy play system of any of paragraphs B1-B3, wherein each first and second protrusion of the plurality of first and second protrusions has about the same dimensions as the other first and second protrusions of the plurality of first and second protrusions.

B5. The toy play system of any of paragraphs B1-B4, wherein each coupling structure of the at least two coupling structures has about the same dimensions as other coupling structures of the at least two coupling structures.

B6. The toy play system of any of paragraphs B1-B5, wherein each first protrusion of the plurality first protrusions includes a first end surface that is configured to engage a support surface when the first toy play set is placed on the support surface, and each second protrusion of the plurality of second protrusions includes a second end surface that is configured to engage the support surface when the second toy play set is placed on the support surface.

B7. The toy play system of paragraph B6, wherein each of the first and second end surfaces are square-shaped.

B8. The toy play system of any of paragraphs B1-B7, wherein the first lower portion includes a first central area that is free from first protrusions such that a first gap is defined between first protrusions along two opposing first edges, and the second lower portion includes a second central area that is free from second protrusions such that a second gap is defined between second protrusions along two opposing second edges.

B9. The toy play system of any of paragraphs B1-B8, wherein the base connector includes opposed first and second end portions, the first end portion includes at least two coupling structures that are configured to be coupled to two first protrusions of the plurality of first protrusions of the first lower portion of the first toy play set to secure the base connector to the first toy play set, and the second end portion includes at least two coupling structures that are configured to be coupled to at least two second protrusions of the second lower portion of the second toy play set to secure the base connector to the second toy play set.

B10. The toy play system of any of paragraphs B1-B9, wherein the first lower portion includes a first central area that is free from first protrusions such that a first gap is defined between first protrusions along two opposing edges.

B11. The toy play system of paragraph B10, wherein, when the base connector is not coupled to the second protrusions of the second toy play set, the first gap is sized to receive one of the first and second end portions of the base connector when the at least two coupling structures of the other of the first and second end portions are coupled to two first protrusions of the plurality of first protrusions of the first lower portion of the first toy play set.

B12. The toy play system of paragraph B11, wherein, when the base connector is not coupled to the first protrusions of the first toy play set, the second gap is sized to receive one of the first and second end portions of the base connector when the at least two coupling structures of the other of the first and second end portions are coupled to two second protrusions of the plurality of second protrusions of the second lower portion of the second toy play set.

B13. The toy play system of paragraph B9, wherein the at least two coupling structures of the first end portion are configured to be coupled to two adjacent first protrusions of the plurality of first protrusions along the same first edge of the first lower portion of the first toy play set.

B14. The toy play system of paragraph B13, wherein the at least two coupling structures of the second end portion are configured to be coupled to two adjacent second protrusions of the plurality of second protrusions along the same second edge of the second lower portion of the second toy play set.

B15. The toy play system of any of paragraphs B9-B14, wherein one coupling structure of the first end portion is configured to be coupled to a first protrusion of the first play set to secure the base connector to the first toy play set, and another coupling structure of the first end portion is configured to be coupled to a second protrusion of the second play set to secure the base connector to the second toy play set.

B16. The toy play system of any of paragraphs B9-B15, further comprising a third play set having a third base, the third base includes opposed third upper and lower portions, the third upper portion includes at least one third play feature, the third lower portion includes a plurality of third protrusions, wherein one coupling structure of the second end portion is configured to be coupled to a protrusion of the plurality of third protrusions to secure the base connector to the third play set.

B17. The toy play system of any of paragraphs B9-B16, further comprising a fourth play set having a fourth base, the fourth base includes opposed fourth upper and lower portions, the fourth upper portion includes at least one fourth play feature, the fourth lower portion includes a plurality of fourth protrusions, wherein another coupling structure of the second end portion is configured to be coupled to a protrusion of the plurality of fourth protrusions to secure the base connector to the fourth play set.

B18. The toy play system of any of paragraphs B1-B17, wherein the base connector includes a frame having the at least two coupling structures.

B19. The toy play system of any of paragraphs B1-B18, wherein each of the at least two coupling structures includes an aperture sized to receive either (1) a first protrusion of the plurality of first protrusions or (2) a second protrusion of the plurality of second protrusions.

B20. The toy play system of paragraph B19, wherein the frame includes a plurality of spaced ribs around each aperture, the plurality of spaced ribs configured to frictionally engage either (1) a first protrusion of the plurality of first protrusions or (2) a second protrusion of the plurality of second protrusions.

C1. A toy play system comprising:

a first play set including:

a first base including:

an first upper play side including at least one first play feature, and a first bottom connector side opposite the first upper play side, the first bottom connector side defined by a first plurality of edges, the first bottom connector side including first regularly-spaced symmetrical protrusions arranged along each of the first plurality of edges;

a second play set including:

a second base including:

a second upper play side including at least one second play feature, and a second bottom connector side opposite the second upper play side, the second bottom connector side defined by a second plurality of edges, the second bottom connector side including second regularly-spaced symmetrical protrusions arranged along each of the second plurality of edges; and a base connector including:

at least one first feature that cooperates with one of the first regularly-spaced symmetrical protrusions, and at least one second feature that cooperates with one of the second regularly-spaced symmetrical protrusions.

Advantages, Features, Benefits

The different embodiments of the toy play systems described herein provide several distinctive features. For example, the illustrative embodiments of toy play systems described herein allow for many possible play configurations due to the modular nature of the coupling mechanisms. Additionally, and among other benefits, illustrative embodiments of the toy play systems described herein allow a user to replicate the appearance and gameplay of a video game with a physical toy system. No known system or device can perform these functions, particularly for representing a video game setting. However, not all embodiments described herein provide the same advantages or the same degree of advantage.

Conclusion

The disclosure set forth above may encompass multiple distinct inventions with independent utility. Although each of these inventions has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only, and do not constitute a characterization of any claimed invention. The subject matter of the invention(s) includes all novel and nonobvious combinations and subcombinations of the various elements, features, functions, and/or properties disclosed herein. The claims below particularly point out certain combinations and subcombinations regarded as novel and nonobvious. Invention(s) embodied in other combinations and subcombinations of features, functions, elements, and/or properties may be claimed in applications claiming priority from this or a related application. Such claims, whether directed to a different invention or to the same invention, and whether broader, narrower, equal, or different in scope to the original claims, also are regarded as included within the subject matter of the invention(s) of the present disclosure.

What is claimed is:

1. A toy play system, comprising:

a first toy play set having a first base, the first base includes opposed upper and lower sides and a first side disposed between the upper and lower sides, the upper side includes at least one play feature, the lower side being a single unitary piece and a plurality of protrusions extends from the lower side; and a base connector having at least two apertures, at least a first aperture of the at least two apertures receives a protrusion of the plurality of protrusions, and at least a second aperture of the at least two apertures receives a protrusion of a second toy play set having a second side, wherein the first side contacts the second side when the at least a first aperture receives the protrusion of the plurality of protrusions and the at least a second aperture receives the protrusion of the second toy play set.

2. The toy play system of claim 1, wherein the base connector includes opposed first and second end portions, the first end portion includes the at least a first aperture, and the second end portion includes the at least a second aperture.

3. The toy play system of claim 2, wherein the lower side includes a central portion that is free from protrusions such that a gap is defined between the plurality of protrusions.

4. The toy play system of claim 3, wherein, when the at least a second aperture does not receive the protrusion of the second toy play set, the gap is sized to receive the second end portion of the base connector when the at least a first aperture of the first end portion frictionally engages a protrusion of the plurality of protrusions.

5. The toy play system of claim 1, wherein the lower side is defined by a plurality of edges, wherein the plurality of protrusions is arranged along one or more of the plurality of edges.

6. The toy play system of claim 5, wherein the plurality of protrusions is arranged along each of the plurality of edges.

7. The toy play system of claim 1, wherein each protrusion of the plurality of protrusions includes an end surface that is configured to engage a support surface when the first toy play set is placed on the support surface.

8. The toy play system of claim 7, wherein the end surface of each protrusion of the plurality of protrusions is square-shaped.

9. The toy play system of claim 1, wherein the base connector includes a frame having the at least two apertures.

10. The toy play system of claim 9, wherein the frame includes a plurality of spaced ribs around each aperture of the at least two apertures.

11. The toy play system of claim 1, wherein the first side is perpendicular to at least one of the upper or lower sides.

12. A toy play system, comprising:

a first toy play set having a first base, the first base includes opposed first upper and lower portions and a first side disposed between the first upper and lower portions, the first upper portion includes at least one first play feature, the first lower portion being a single unitary piece and a plurality of first protrusions extends from the first lower portion;

a second toy play set having a second base, the second base includes opposed second upper and lower portions and a second side disposed between the second upper and lower portions, the second upper portion includes at least one second play feature, the second lower portion being a single unitary piece and a plurality of second protrusions extends from the second lower portion; and a base connector having a plurality of apertures, one aperture of the plurality of apertures is configured to receive a first protrusion of the plurality of first protrusions, and another aperture of the plurality of apertures is configured to receive a second protrusion of the plurality of second protrusions, wherein the first side contacts the second side when the one aperture receives the first protrusion and the another aperture receives the second protrusion.

13. The toy play system of claim 12, wherein the base connector includes opposed first and second end portions, the first end portion includes at least two apertures of the plurality of apertures that are configured to receive two first protrusions of the plurality of first protrusions of the first toy play set, and the second end portion includes at least two apertures of the plurality of apertures that are configured to receive at least two second protrusions of the second toy play set.

14. The toy play system of claim 13, wherein the at least two apertures of the first end portion are configured to receive two adjacent first protrusions of the plurality of first protrusions, and the at least two apertures of the second end portion are configured to receive two adjacent second protrusions of the plurality of second protrusions.

15. The toy play system of claim 13, wherein one aperture of the at least two apertures of the first end portion is configured to receive a first protrusion of the plurality of first protrusions of the first play set, and another aperture of the at least two apertures of the first end portion is configured to receive a second protrusion of the plurality of second protrusions of the second play set.

16. The toy play system of claim 15, further comprising a third play set having a third base, the third base includes opposed third upper and lower portions, the third upper portion includes at least one third play feature, the third lower portion being a single unitary piece and a plurality of third protrusions extends from the third lower portion, wherein one aperture of the at least two apertures of the second end portion is configured to receive a third protrusion of the plurality of third protrusions.

17. The toy play system of claim 16, further comprising a fourth play set having a fourth base, the fourth base includes opposed fourth upper and lower portions, the fourth upper portion includes at least one fourth play feature, the fourth lower portion being a single unitary piece and a plurality of fourth protrusions extends from the fourth lower portion, wherein another aperture of the at least two apertures of the second end portion is configured to receive a fourth protrusion of the plurality of fourth protrusions.

18. The toy play system of claim 12, wherein the first lower portion is defined by a plurality of first edges, wherein the plurality of first protrusions are arranged along each of the plurality of first edges, and wherein the second lower portion is defined by a plurality of second edges, wherein the plurality of second protrusions are arranged along each of the plurality of second edges.

19. The toy play system of claim 12, wherein the base connector includes a frame having the plurality of apertures.

20. The toy play system of claim 12, wherein the base connector includes a plurality of spaced ribs around each aperture of the plurality of apertures, the plurality of spaced ribs configured to frictionally engage one or more of the first protrusion or the second protrusion.

* * * * *